US011340013B2

(12) United States Patent
Park et al.

(10) Patent No.: US 11,340,013 B2
(45) Date of Patent: May 24, 2022

(54) APPARATUS FOR LIQUEFYING NATURAL GAS AND METHOD FOR LIQUEFYING NATURAL GAS

(71) Applicants: SUNG-IL ENCARE Co., Ltd., Busan (KR); KOGAS-TECH, Daejeon (KR); Korea Institute of Industrial Technology, Cheonan-si (KR)

(72) Inventors: Jang-ik Park, Busan (KR); Ta Kwan Woo, Busan (KR); Taehee Kang, Busan (KR); Heeseung Na, Daejeon (KR); Hweeung Kwon, Sejong-si (KR); Gaehyun Nam, Hwaseong-si (KR); Young Cheol Lee, Busan (KR); Dong-Ha Lim, Busan (KR)

(73) Assignees: SUNG-IL ENCARE Co., Ltd., Busan (KR); KOGAS-TECH, Dajeon (KR); Korea Institute of Industrial Technology, Cheonan-si (KR)

( * ) Notice: Subject to any disclaimer, the term of this patent is extended or adjusted under 35 U.S.C. 154(b) by 417 days.

(21) Appl. No.: 16/233,719

(22) Filed: Dec. 27, 2018

(65) Prior Publication Data

US 2020/0208910 A1 Jul. 2, 2020

(51) Int. Cl.
*F25J 1/00* (2006.01)
*F25J 1/02* (2006.01)

(52) U.S. Cl.
CPC ..... *F25J 1/0022* (2013.01); *F25J 1/004* (2013.01); *F25J 1/0052* (2013.01); *F25J 1/0087* (2013.01);

(Continued)

(58) Field of Classification Search
CPC ..... F25J 1/0022; F25J 2230/30; F25J 1/004; F25J 1/0052; F25J 1/0087; F25J 1/0204; F25J 2205/02; F25J 2230/08; F25J 2230/60; F25J 2240/40; F25J 2245/02; F25J 2270/08; F25J 2270/90
See application file for complete search history.

(56) References Cited

U.S. PATENT DOCUMENTS 4,172,711 A * 10/1979 Bailey ..... F25J 1/0022 62/619
6,289,692 B1 * 9/2001 Houser ..... F25J 1/0022 62/613

(Continued)

*Primary Examiner* — Gordon A Jones
(74) *Attorney, Agent, or Firm* — Novick, Kim & Lee, PLLC; Jae Youn Kim

(57) ABSTRACT

Provided are an apparatus and method for liquefying natural gas. The apparatus for liquefying natural gas includes a gas compressor configured to receive and compress the natural gas from a natural gas feed stream, a heat exchanging unit configured to cool a high-pressure natural gas passing through the gas compressor through heat exchange, an expansion valve configured to expand the cooled natural gas passing through the heat exchanging unit, a hold-up drum configured to phase-separate a gas-liquid mixture produced by passing through the expansion valve and divide the gas-liquid mixture into a liquefied natural gas and a cryogenic recycle gas having nitrogen content greater than that of the liquefied natural gas so as to discharge the liquefied natural gas and the cryogenic recycle gas, and a bypass line configured to provide the recycle gas discharged from the hold-up drum to the heat exchanging unit.

8 Claims, 4 Drawing Sheets

(52) U.S. Cl.
CPC ..... *F25J 1/0204* (2013.01); *F25J 2205/02* (2013.01); *F25J 2230/08* (2013.01); *F25J 2230/30* (2013.01); *F25J 2230/60* (2013.01); *F25J 2240/40* (2013.01); *F25J 2245/02* (2013.01); *F25J 2270/08* (2013.01); *F25J 2270/90* (2013.01)

(56) References Cited

U.S. PATENT DOCUMENTS

| | | | | |
|---|---|---|---|---|
| 6,494,060 | B1 * | 12/2002 | Bergman, Jr. ..... | F25J 3/04284 62/652 |
| 7,637,122 | B2 * | 12/2009 | Turner ..... | F25J 1/0204 62/532 |
| 2003/0177785 | A1 * | 9/2003 | Kimble ..... | F25J 1/0202 62/613 |
| 2003/0182947 | A1 * | 10/2003 | Kimble ..... | F17C 7/00 62/48.2 |
| 2008/0170948 | A1 * | 7/2008 | Martinez ..... | F25J 1/0298 417/53 |
| 2011/0011127 | A1 * | 1/2011 | Evans ..... | F25J 1/023 62/613 |
| 2018/0231305 | A1 * | 8/2018 | Pierre, Jr. ..... | F25J 3/0257 |
| 2019/0093946 | A1 * | 3/2019 | Krishnamurthy ..... | F25J 1/0267 |

* cited by examiner

APPARATUS FOR LIQUEFYING NATURAL GAS AND METHOD FOR LIQUEFYING NATURAL GAS

BACKGROUND OF THE INVENTION

Field of the Invention

The present disclosure is an invention developed under support of National Research and Development Project in Republic of Korea, and information of National Research and Development Project that supports the present disclosure is as follow:

Project Serial Number: 10077506

Government Department Name: Ministry of Trade, Industry and Energy

Research Administration Authority Name: Korea Evaluation Institute of Industrial Technology Research Program Name: Industrial Strategic Technology Development Program Research Project Name: Development of engineering package and empirical technology for mobile type small onshore LNG plant Contribution Rate: 10%

Organizing Institution: SUNG-IL ENCARE Co., Ltd,

Period of Research: Apr. 1, 2017 to Mar. 31, 2021

The present invention relates to an apparatus and method for liquefying a natural gas, and more particularly, to an apparatus for liquefying natural gas containing nitrogen and method for liquefying natural gas containing nitrogen.

Description of the Related Art

The abundance of natural gas makes it possible to replace diesel in many high horsepower industries including ground transport, marine transport, and rail transport with liquefied natural gas (LNG). This new paradigm has attracted worldwide interest in small-scale LNG plants in which a gas is liquefied and transported to other destinations.

The key values of a small-scale liquefaction system are that production facilities are located at the demand points to reduce long-haul road transport costs, and that production and demand points more closely match each other to reduce storage capacity and costs. In addition, the small-scale liquefaction system may allow for consideration for small market segments in which cryogenic liquefaction plants could not be historically provided for example, peak shaving at a small gas usage place.

The natural gas that is transported through pipelines (hereinafter, referred to as a 'pipeline natural gas') may contain, for example, typically 2 mol % of nitrogen and maximally 5.5 mol % of nitrogen in the US market. The natural gas that is not connected to the pipeline network may contain 10 mol % or less of nitrogen. Impurities such as carbon dioxide ($CO_2$) and water ($H_2O$) contained in the natural gas may be easily removed by conventional techniques. On the other hand, since nitrogen is not easily removed, a content of nitrogen in the pipeline network is allowed up to a specific level.

There are many well-known natural gas liquefaction technologies. The two simplest techniques that are capable of being applied in a modular manner may include pre-cooled Joule-Thomson cycle and nitrogen refrigerant cycles which are called a closed Brayton/Claude cycle. Both the two techniques are relatively simple and have robust cycles, but their efficiency is not high. The pre-cooled Joule-Thomson cycle includes a closed cycle that pre-cools compressed natural gas, which is partially liquefied by using expansion through a Joule-Thomson valve. Here, for example, fluorocarbon or propane is used as a refrigerant for the closed cycle. The nitrogen refrigerant cycle includes a closed cycle using a compressor, a turbo expander, and a heat exchanger, and nitrogen is used as a working fluid in the closed cycle. Nitrogen gas is cooled and liquefied in the heat exchanger so as to be used for pre-cooling natural gas feeds.

The liquefaction techniques that are available in addition to the above-described two cycles use more complex cycles including mixed refrigerants which are mainly disposed in different modes. One of the major issues meeting the spread of use of the mixed refrigerants is the fact that some working fluid leaks in all compression systems. In the mixed refrigerant system, the working fluid leaks at different rates to change a composition of the mixed refrigerant. The maintenance of mixed refrigerant is important due to the fact that the composition has to be continuously monitored, and a specific compound has to be added to maintain the optimum composition. The lighter component in the mixture of the mixed refrigerants may leak at a faster rate, and such leakage of the refrigerants has to be continuously compensated.

Another point that may be pointed out as a limitation related to such natural gas liquefaction is that there are a number of cases where impurities including the nitrogen are contained in the natural gas. Exemplary examples of the impurities except for nitrogen may include a material having hydrocarbon content heavier than that of methane, i.e., materials that are called heavy hydrocarbons. The heavy hydrocarbons may cause freezing within the liquefaction system. Also, there is another technical difficulty in that the natural gas is not completely identical depending on the supply manners and stages of the natural gas. On the other hand, a process for converting the natural gas to a relatively low-pressure state (e.g., the normal LNG), a high-pressure state (e.g., the normal CNG), or an intermediate pressure (e.g., the normal PNG) for convenience of use due to differences and limitations of transportation and storage facilities may be required. Such a process may mostly accompany heat transfer due to the pressure change. However, in many cases, heat energy may be discarded as it is.

SUMMARY OF THE INVENTION

An object of the prevent invention is to provide an apparatus and method for liquefying a natural gas, which are capable of providing an alternative to the above-described limitations indicated in the background art, and particularly, to provide an apparatus and method for liquefying a natural gas containing nitrogen. The efficiency of liquefaction process may be improved in consideration of nitrogen content of the natural gas, and also, overall technical improvement of the liquefaction process may be achieved while maintaining acceptable nitrogen content.

The object of the present invention is not limited to the aforesaid, but other objects not described herein will be clearly understood by those skilled in the art from descriptions below.

Embodiments of the present invention provide an apparatus for liquefying a natural gas including: a gas compressor configured to receive a natural gas from a natural gas feed stream and compress the received natural gas; a heat exchanging unit configured to cool a high-pressure natural gas passing through the gas compressor through heat exchange; an expansion valve configured to expand the cooled natural gas passing through the heat exchanging unit so as to subcool the natural gas; a hold-up drum configured to phase-separate a gas-liquid mixture produced by passing through the expansion valve and divide the gas-liquid mixture into a liquefied natural gas and a cryogenic recycle gas having nitrogen content greater than that of the liquefied natural gas so as to discharge the liquefied natural gas and the cryogenic recycle gas; and a bypass line configured to provide the recycle gas discharged from the hold-up drum to the heat exchanging unit so as to be heat-exchanged, in which at least a portion of the recycle gas passing through the heat exchanging unit is discharged from the bypass line.

The apparatus may further include a recycle gas circulation line connected to the bypass line to combine at least a portion of the recycle gas discharged from the bypass line into the natural gas feed stream.

The apparatus may further include a gas purging valve configured to control a discharge amount of the recycle gas in the bypass line so as to adjust an amount of nitrogen accumulated in the natural gas feed stream.

The apparatus may further include a power generation module configured to generate power by using the recycle gas discharged from the gas purging valve as a fuel so that at least a portion of the generated power is provided to the gas compressor.

The apparatus may further include: a recycle gas compressor configured to compress the recycle gas in the recycle gas circulation line and provide the compressed recycle gas to the natural gas feed stream; and a refrigerant compressor installed in a refrigerant cycle that is independent of the bypass line to compress a refrigerant circulated through the refrigerant cycle and heat-exchanged with the high-pressure natural gas, in which the power may be provided from the power generation module to the gas compressor, the recycle gas compressor, and the refrigerant compressor.

The apparatus may further include a branch line branched from a connection point between the bypass line and the recycle gas circulation line to the power generation module, in which the gas purging valve may include a three-way valve configured to control a flow path at a point at which the bypass line, the recycle gas circulation line, and the branch line are combined with each other.

The apparatus may further include: a storage tank configured to store the liquefied natural gas discharged from the hold-up drum; and an evaporation gas circulation line configured to supply an evaporation gas produced in the storage tank to the recycle gas circulation line so that the evaporation gas is combined into the natural gas feed stream.

The apparatus may further include a supply line connected to the bypass line to provide the recycle gas discharged from the bypass line to a consumer site.

The apparatus may further include: a storage tank configured to store the liquefied natural gas discharged from the hold-up drum; and an evaporation gas combining line configured to combine an evaporation gas produced in the storage tank with the supply line.

The heat exchanging unit may include: a low-temperature heat exchanger configured to receive the recycle gas discharged from the hold-up drum so that the received recycle gas is heat-exchanged with the high-pressure natural gas; and a high-temperature heat exchanger configured to receive the recycle gas discharged from the low-temperature heat exchanger so that the received recycle gas is heat-exchanged with the high-pressure natural gas at a front end of the low-temperature heat exchanger.

The heat exchanging unit may further include a refrigerant heat exchanger configured to circulate a refrigerant and heat-exchange in between the high-temperature heat exchanger and the low-temperature heat exchanger so that the refrigerant is heat-exchanged with the high-pressure natural gas.

The high-temperature heat exchanger and the low-temperature heat exchanger may be connected in series to each other through the bypass line, and the refrigerant heat exchanger may circulate the refrigerant through a refrigerant cycle that is independent of the bypass line.

The apparatus may further include: a pretreatment cooler configured to heat-exchange the natural gas supplied to the gas compressor with a portion of the liquefied natural gas discharged from the hold-up drum so as to cool the natural gas; and a heavy hydrocarbon separator configured to phase-separate the natural gas cooled by passing through the pretreatment cooler so as to remove liquefied heavy hydrocarbons and supply the gaseous natural gas to the gas compressor.

The apparatus may further include a compressed natural gas (CNG) discharge line disposed at a front end of the heat exchanging unit to branch the high-pressure natural gas stream passing through the gas compressor so that at least a portion of the high-pressure natural gas is discharged to the outside.

Embodiments of the present invention also provide a method for liquefying a natural gas including: (a) receiving a natural gas from a natural gas feed stream to compress the natural gas by using a gas compressor; (b) cooling the high-pressure natural gas passing through the gas compressor through heat-exchange in a heat exchanging unit; (c) expanding the cooled natural gas passing through the heat exchanging unit in an expansion valve to subcool the natural gas; (d) phase-separating a gas-liquid mixture produced by passing through the expansion valve in a hold-up drum to divide the gas-liquid mixture into a liquefied natural gas and a cryogenic recycle gas having nitrogen content greater than that of the liquefied natural gas and thereby to discharge the liquefied natural gas and the cryogenic recycle gas; and (e) providing the recycle gas discharged from the hold-up drum to the heat exchanging unit through a bypass line so as to be heat-exchanged, in which at least a portion of the recycle gas passing through the heat exchanging unit is discharged from the bypass line.

(e) The providing of the recycle gas may include combining at least a portion of the recycle gas discharged from the bypass line through a recycle gas circulation line connected to the bypass line into a natural gas feed stream and to control a discharge amount of recycle gas in the bypass line so as to adjust an amount of nitrogen accumulated in the natural gas feed stream.

The method may further include, before (a) the receiving of the natural gas: heat-exchanging the natural gas supplied to the gas compressor with a portion of the liquefied natural gas discharged from the hold-up drum to cool the natural gas; and phase-separating the natural gas cooled by heat-exchanging with a portion of the liquefied natural gas discharged from the hold-up drum to remove liquefied heavy hydrocarbons and supply the gaseous natural gas to the gas compressor.

The method may further include, between (a) the receiving of the natural gas and (b) the cooling of the high-pressure natural gas, branching the high-pressure natural gas stream passing through the gas compressor to a compressed gas discharge line to discharge at least a portion of the high-pressure natural gas to the outside.

A recycle gas circulation line combining at least a portion of the recycle gas discharged from the bypass line into the natural gas feed stream may be connected to the bypass line, a recycle gas compressor compressing the recycle gas to provide the compressed recycle gas to the natural gas feed stream may be installed in the recycle gas circulation line, and a refrigerant compressor compressing a refrigerant circulated through a refrigerant cycle and heat-exchanged with the high-pressure natural gas may be installed in the refrigerant cycle that is independent of the bypass line, in which outputs of the gas compressor, the recycle gas compressor, and the refrigerant compressor may be adjusted according to a ratio of the high-pressure natural gas discharged to the compressed gas discharge line to the high-pressure natural gas passing through the gas compressor.

(e) The providing of the recycle gas may include providing the recycle gas discharged from the bypass line to a consumer site through a supply line connected to the bypass line.

DETAILED DESCRIPTION OF THE PREFERRED EMBODIMENTS

Figure 1:
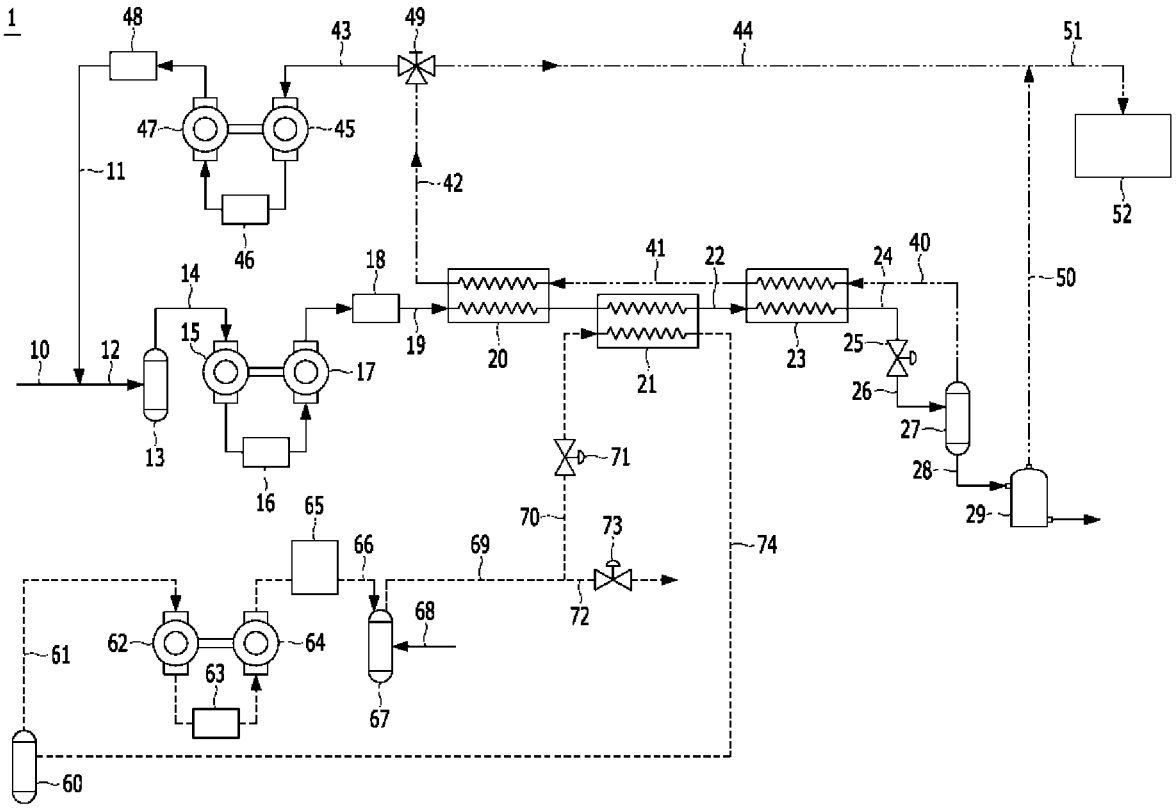
FIG. 1 is a view illustrating a configuration of an apparatus for liquefying natural gas according to a first embodiment of the present invention.

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. Like reference numerals refer to like elements throughout the specification.

In this specification, the singular forms include plural references, unless the context clearly indicates otherwise. Thus, for example, reference to the "gas" may include reference to a singular or plurality of materials, and reference to the "conversion" may refer to a singular or plurality of processes. Also, unless expressly stated otherwise, the processes may be performed sequentially and/or in parallel and be performed in a common container or in a separate container.

Also, as used in this specification with regard to an identified feature or situation, "substantially" refers to a sufficiently small degree of deviation, which is measurable from the identified feature and situation without being deviated. An exact degree of the acceptable deviation may vary depending on the particular case.

Also, the term "liquefied" means not only that a gaseous natural gas is phase-changed into a liquid natural gas, but also that a supercritical natural gas compressed at a critical pressure or more is changed into a liquefied natural gas having a liquid state.

Also, the "line" refers to a flow path of a fluid and/or a fluid flow formed along a corresponding flow path, and for example, each line may refer to a pipe forming the flow path of the fluid or the fluid (a fluid stream) itself which flows along the pipe.

Also, a pressure unit bara means an absolute pressure [bar (absolute)], and barg means a gauge pressure [bar (gauge)]. The absolute pressure is sum of gauge pressure and atmospheric pressure.

Also, when a heat exchanging unit is constituted by a plurality of heat exchangers, only a portion of the heat exchangers may be designated with a number while being called a heat exchanging unit as necessary. This is intended to make an operation and structure of the heat exchanging unit clearer, and the context will be clear.

Hereinafter, an apparatus for liquefying natural gas and a method for liquefying natural gas according to the present invention will be described in detail with reference to FIGS. 1 to 4. For simplifying explanation, each of embodiments of the apparatus for liquefying natural gas will be described with reference to FIGS. 1 to 4, and then, the method for liquefying natural gas will be described based on the description of the apparatus for liquefying natural gas.

First, an apparatus for liquefying natural gas according to a first embodiment of the present invention will be described in detail with reference to FIG. 1.

FIG. 1 is a view illustrating a configuration of an apparatus for liquefying natural gas according to a first embodiment of the present invention.

Referring to FIG. 1, an apparatus for liquefying natural gas 1 according to a first embodiment of the present invention receives a natural gas from a natural gas feed stream 10 containing nitrogen to treat the natural gas. The apparatus for liquefying natural gas 1 produces a liquefied natural gas through a process of pre-cooling the natural gas through heat-exchange and a process of subcooling the pre-cooled natural gas to convert the natural gas into a cryogenic two-phase fluid. The pre-cooling process and the subcooling process accompanying the fluid expansion may be organically integrated with each other. Thus, the entire integrated process may energy-efficiently be operated by the phase change of the fluid, which is accompanied by the temperature change, the heat input and output, and the heat transfer through the fluid. Energy of the recycle gas during the liquefaction process is used not only for the pre-cooling process but also for the recovery of the electric energy to operate the apparatus. A circulation amount of recycle gas may be controlled to adjust a power generation amount and maintain nitrogen content of a finally produced liquefied natural gas to an appropriate level.

The apparatus for liquefying natural gas 1 according to the first embodiment of the present invention is constituted as follows. The apparatus for liquefying natural gas 1 includes gas compressors 15 and 17 that receive a natural gas from a natural gas feed stream 10 to compress the natural gas, heat exchanging units 20, 21, and 23 for cooling the high-pressure natural gas passing through the gas compressors 15 and 17 through heat exchange, an expansion valve 25 for expanding the cooled natural gas passing through the heat exchanging units 20, 21, and 23 to subcool the natural gas, a hold-up drum 27 for phase-separating a gas-liquid mixture produced by passing through the expansion valve 25 to separate the gas-liquid mixture into a liquefied natural gas and a cryogenic recycle gas having nitrogen content greater than that of the liquefied natural gas so as to discharge the liquefied natural gas and the cryogenic recycle gas, and bypass lines 40, 41, and 42 for providing the recycle gas discharged from the hold-up drum 27 to the heat exchanging units 20 and 23 so as to be heat-exchanged, where in at least a portion of the recycle gas passing through the heat exchanging units 20 and 23 is discharged from the bypass lines 40, 41, and 42. According to this embodiment, the apparatus for liquefying natural gas 1 may further include recycle gas circulation lines 11 and 43 connected to the bypass lines 40, 41, and 42 to combine at least a portion of the recycle gas discharged from the bypass lines 40, 41, and 42 into the natural gas feed stream and a gas purging valve configured to control a discharge amount of the recycle gas in the bypass lines 40, 41, and 42 so as to adjust an amount of nitrogen accumulated in the natural gas feed stream 10. Hereinafter, the apparatus for liquefying natural gas 1 according to the first embodiment of the present invention will be described in more detail with reference to the accompanying drawing.

The natural gas feed stream 10 may contain nitrogen in addition to methane that is a main component. Here, other impurities that are capable of being potentially frozen at a cryogenic temperature may be pre-treated to be removed. For example, the impurities to be pre-treated may be components such as hydrogen sulfide, mercury, carbon dioxide, and water. The recycle gas that is phase-separated in the hold-up drum 27 may be combined into the natural gas feed stream 10. For this, the natural gas feed stream 10 may be partially intersected/combined with the recycle gas circulation lines 11 and 43 connected to the bypass lines 40, 41, and 42. The recycle gas is substantially a component of the natural gas feed stream 10 provided to the apparatus and corresponds to a component (including a nitrogen component) that remains in a gaseous state even during the subcooling in the natural gas feed stream 10. Thus, even after the recycle gas is combined, the natural gas feed stream 10 is not changed in component. However, the nitrogen content may increase due to the repeated cycle, and thus, the nitrogen component may be excessively accumulated. Thus, the discharging of the recycle gas from the bypass lines 40, 41, and 42 may be controlled to solve this limitation.

The gas compressors 15 and 17 receive the natural gas from the natural gas feed stream 10 to compress the natural gas. For example, each of the gas compressors 15 and 17 may have a structure in which a multi-stage rotary blade is provided to compress a fluid. Also, for example, the gas compressor may include a reciprocating compressor having a piston and the like. Each of the gas compressors 15 and 17 may be realized in various forms capable of compressing a fluid. In this embodiment, gas compressors 15 and 17 may be two-stage compressor including a first gas compression stage 15 and a second gas compression stage 17 and each of them may be a reciprocating compressor. A gas compressor intercooler 16 cooling the gas stream that is increased in temperature while being compressed by the first gas compressor stage 15 up to an inflow temperature of the second gas compression stage 17 may be installed in a pipeline connecting an outlet part of the first gas compression stage 15 to an inlet part of the second gas compression stage 17. Also, a gas compressor aftercooler 18 cooling the gas stream that is increased in temperature while being compressed by the second gas compressor stage 17 may be installed in a pipeline 19 connecting an outlet part of the second gas compression stage 17 to the heat exchanging units 20, 21, and 23.

A gas compressor suction drum 13 separating and removing a liquid material may be installed at a front end of the compressors 15 and 17. The gas compressor suction drum 13 captures any condensation to protect heads of the gas compressors 15 and 17 from liquid droplets that are accompanied in a spray state in the natural gas supplied to the gas compressors 15 and 17. The gas compressor suction drum 13 may receive a combined stream 12 in which the recycle gas is combined into the natural gas feed stream 10 to separate a liquid component so that only the natural gas that is in the gaseous state is supplied to the gas compressors 15 and 17. For example, the gas compressor suction drum 13 may be provided as a gas-liquid separator for separating a phase of a gas-liquid mixed fluid by using a density difference. The gas compressors 15 and 17 may receive the natural gas that is in a dry state by passing through the gas compressor suction drum 13 to compress the natural gas.

The heat exchanging units 20, 21, and 23 cool the high-pressure natural gas passing through the gas compressors 15 and 17 through the heat-exchange. This process is the pre-cooling process before expanding the high-pressure natural gas in the expansion valve 25 to subcool the natural gas and is organically integrated with the subsequent subcooling process. That is, the cryogenic recycle gas produced in the expansion valve 25, which will be described later, and separated at the hold-up drum 27 may be used as a refrigerant in the pre-cooling process. The recycle gas undergoing this process may be combined into the natural gas feed stream 10 and then repeatedly used. Since the recycle gas is continuously produced in the process of liquefying the natural gas, there is no limitation in supplementing the recycle gas. Thus, the leakage of the refrigerant in the conventional closed cycle may be effectively prevented.

In this embodiment, the heat exchanging units 20, 21 and 23 may be constituted by a plurality of heat exchangers that cool the high-pressure natural gas compressed in the gas compressors 15 and 17 at different temperatures in a multistage manner. The heat exchanging units 20, 21, and 23 may include a low-temperature heat exchanger 23 receiving the recycle gas discharged from the hold-up drum 27 to heat-exchange the recycle gas with the high-pressure natural gas passing through the gas compressors 15 and 17 and a high-temperature heat exchanger 20 receiving the recycle gas discharged from the low-temperature heat exchanger 23 to heat-exchange the recycle gas with the high-pressure natural gas at a front end of the low-temperature heat exchanger 23. Also, a refrigerant heat exchanger 21 configured to circulate a refrigerant (which may be a refrigerant other than the recycle gas, for example, propane) and heat-exchange in between the high-temperature heat exchanger 20 and the low-temperature heat exchanger 23 to heat-exchange the refrigerant with the high-pressure natural gas may be further provided.

The high-temperature heat exchanger 20 and the low-temperature heat exchanger 23 may be connected in series to each other through the bypass lines 40, 41, and 42. For example, the bypass lines 40, 41, and 42 may include a line 40 supplying the recycle gas from the hold-up drum 27 to the low-temperature heat exchanger 23, a line 41 supplying the recycle gas heat-exchanged in the low-temperature heat exchanger 23 to the high-temperature heat exchanger 20, and a line 42 discharging at least a portion of the recycle gas passing through the high-temperature heat exchanger 20 to the recycle gas circulation lines 11 and 43 and the branch line 44. The high-temperature heat exchanger 20 and the low-temperature heat exchanger 23 may be connected in series to each other to allow the recycle gas to pass in a direction opposite to the transfer direction of the high-pressure natural gas and reduce the temperature of the high-pressure natural gas in stages. The energy injected into the liquefaction process may be more efficiently recovered through the multistage heat exchange process of the recycle gas.

The refrigerant heat exchanger 21 may circulate the refrigerant in a refrigerant cycle that is independent of the bypass lines 40, 41, and 42. The refrigerant heat exchanger 21 may be operated at an intermediate temperature between the low-temperature heat exchanger 23 and the high-temperature heat exchanger 20 to improve cooling efficiency. The refrigerant heat exchanger 21 may circulate the refrigerant in an independent cycle. For example, the independent refrigerant cycle may be constituted by refrigerant circulation lines 61, 66, 69, 70, and 74 connected to the refrigerant heat exchanger 21. Refrigerant compressors 62 and 64 compressing refrigerant, a refrigerant compressor suction drum 60 removing a liquid component contained in the refrigerant introduced into the refrigerant compressors 62 and 64, a surge drum 67 storing the refrigerant compressed in the refrigerant compressor, and a refrigerant control valve 71 controlling the low-temperature refrigerant supplied from the surge drum 67 to the refrigerant heat exchanger 21 may be provided on such refrigerant circulation lines. For example, the refrigerant control valve 71 may be provided as a Joule-Thomson valve that expands a refrigerant stream through a Joule-Thomson process.

Here, the refrigerant compressors 62 and 64 may be two-stage compressor including a first refrigerant compression stage 62 and a second refrigerant compression stage 64. A refrigerant compressor intercooler 63 cooling the refrigerant stream that is increased in temperature while being compressed by the first refrigerant compressor stage 62 up to an inflow temperature of the second refrigerant compression stage 64 may be installed in a pipeline connecting an outlet part of the first refrigerant compression state 62 to an inlet part of the second refrigerant compression stage 64. Also, a gas compressor aftercooler 65 cooling the refrigerant stream that is increased in temperature while being compressed by the second refrigerant compressor stage 64 may be installed in a pipeline connecting an outlet part of the second refrigerant compression stage 64 to the surge drum 67. A refrigerant injection line 68 additionally supplying the refrigerant lost while circulating the refrigerant cycle may be connected to the surge drum 67. As necessary, a line 72 discharging the refrigerant and a refrigerant control valve 73 controlling the refrigerant in the discharge line may be installed in the pipeline constituting the refrigerant cycle.

Each of the high-temperature heat exchanger 20, the refrigerant heat exchanger 21, and the low-temperature heat exchanger 23 may be, for example, a cryogenic heat exchanger and be provided as a printed circuit heat exchanger (PCHE) or a typical aluminum plate heat exchanger. Each of the high-temperature heat exchanger 20, the refrigerant heat exchanger 21, and the low-temperature heat exchanger 23 constituting the heat exchanging units 20, 21, and 23 may be adequately insulated to minimize heat introduction from the surroundings.

The expansion valve 25 expands the natural gas cooled while passing through the heat exchanging units 20, 21, and 23 to subcool the cooled natural gas [Here, at least a portion of the cooled natural gas may be condensed or liquefied by the process passing through the heat exchanging units described above]. The expansion valve 25 may be provided as a Joule-Thomson valve, and the compressed natural gas may be expanded and cooled by a Joule-Thomson process. In the expansion process, the natural gas may be changed in volume by a pressure difference due to an isenthalpic process and thus be cooled to a cryogenic temperature. As described above, in the subcooling process, a portion of the natural gas may be partially liquefied, and a gas-liquid mixture may be produced through a phase change such as production of a flash gas.

The hold-up drum 27 phase-separates the gas-liquid mixture produced by passing through the expansion valve 25 to separate the gas-liquid mixture into a liquefied natural gas and a cryogenic recycle gas having a nitrogen content greater than that of the liquefied natural gas and thereby to discharge the liquefied natural gas and the cryogenic recycle gas. The cryogenic gas-liquid mixture produced through the subcooling is phase-separated in the hold-up drum 27 disposed at a rear end of the expansion valve 25 to produce and discharge a liquefied natural gas (LNG). The cryogenic recycle gas separated from the liquefied natural gas in the gas-liquid mixture is discharged through a path that is different from that of the liquefied natural gas and is used as the refrigerant in the pre-cooling process and then combined again into the natural gas feed stream 10. The recycle gas may be maintained in the gaseous state even when being subcooled due to a low liquefaction temperature thereof, and may be a gas that is increased in nitrogen content and contains methane as a main component. A storage tank 29 connected to the liquefied natural gas discharge line 28 to store the liquefied natural gas discharged from the hold-up drum 27 may be disposed at a rear end of the hold-up drum 27. The liquefied natural gas may be stored in the storage tank 29 and then supplied to the usage place. For example, the hold-up drum 27 may be provided as a gas-liquid separator that separates a phase of a gas-liquid mixed fluid by using a density difference.

The recycle gas discharged from the hold-up drum 27 is recirculated along the above-described bypass lines 40, 41, and 42 and the recycle gas circulation lines 11 and 43 connected to the bypass lines 40, 41, and 42. The bypass lines 40, 41, and 42 and the recycle gas circulation lines 11 and 43 may mean not only a pipe through which the recycle gas moves, but also a recycle gas stream flowing through the pipe. The bypass lines 40, 41, and 42 serve to heat-exchange the recycle gas discharged from the hold-up drum 27 in the heat exchanging units 20 and 23 and discharge at least a portion of the recycle gas, and the recycle gas circulation lines 11 and 43 serve to combine at least a portion of the recycle gas discharged from the bypass lines 40, 41, and 42 into the natural gas feed stream 10. Each of the bypass lines 40, 41, and 42 and the recycle gas circulation lines 11 and 43 may mean a pipe line through which the recycle gas is circulated from the hold-up drum 27 to the natural gas feed stream 10 or an entire flow of the recycle gas. As described above, the bypass lines 40, 41, and 42, and the recycle gas circulation lines 11 and 43 may include a plurality of lines disposed in the recycle gas flow path. The recycle gas may be circulated through the connection structure of the bypass lines 40, 41, and 42 and the recycle gas circulation lines 11 and 43 to recover heat energy and also to combine the recycle gas into the natural gas feed stream 10 so as to be reused. Also, in this process, a portion of the recycle gas may be excluded from the circulation process and partially discharged [that is, the recycle gas is discharged through the other path except for the recycle gas circulation lines 11 and 43 from the bypass lines 40, 41, and 42] to control a circulation amount of recycle gas and also adjust an amount of nitrogen accumulated in the natural gas feed stream.

A valve structure for discharging the recycle gas may be provided in the bypass lines 40, 41, and 42. At least a portion of the recycle gas may be discharged from the bypass lines 40, 41, and 42 by using the valve. Here, the discharging may mainly mean that at least a portion of the recycle gas moves from the bypass lines 40, 41, and 42 to the other line (for example, the recycle gas circulation line or the branch line]. However, as necessary, the discharging may include that a portion of the recycle gas is exhausted to the outside of the pipeline. The gas purging valve 49 may have a function of changing a flow path or of changing flow path at a point where pipe lines are connected or combined to change a flow direction of the recycle gas or distribute and move the recycle gas. The gas purging valve 49 may control a discharge amount of recycle gas in the bypass lines 40, 41, and 42 to adjust an amount of nitrogen accumulated in the natural gas feed stream 10. Particularly, an amount of recycle gas discharged by the gas purging valve 49 may be changed according to a target concentration of nitrogen contained in the liquefied natural gas discharged from the hold-up drum 27. That is, an acceptable concentration of nitrogen in the liquefied natural gas, which is a final product of the apparatus, may be set as a target concentration, and a discharge amount of recycle gas may be precisely adjusted by using the gas purging valve 49 so that the nitrogen concentration is maintained at a corresponding concentration.

In this embodiment, since the recycle gas is repeatedly circulated along the bypass lines 40, 41, and 42 and the recycle gas circulation lines 11 and 43, an amount of nitrogen accumulated in the natural gas may increase as the cycle increases. This may have an influence on the natural gas feed stream 10 and the nitrogen concentration in the liquefied natural gas that is finally produced from the natural gas feed stream 10, and thus, a proper control for this may be required. The gas purging valve 49 provided in the bypass lines 40, 41, and 42 may directly change a flow rate of the recycle gas having high nitrogen content, and thus is very effective for such control. That is, a flow path may be adjusted through the gas purging valve 49 to reduce an amount of recycle gas moving from the bypass lines 40, 41, and 42 to the recycle gas circulation lines 11 and 43. Correspondingly, an amount of nitrogen accumulated in the natural gas feed stream 10 and an amount of nitrogen contained in the finally produced liquefied natural gas may be also reduced, and vice versa. The acceptable concentration of nitrogen in the liquefied natural gas, which is finally produced, may be maintained to an appropriate level while controlling the circulation amount of recycle gas circulated along the bypass lines 40, 41, and 42 and the recycle gas circulation lines 11 and 43.

The bypass lines 40, 41, and 42, the recycle gas circulation lines 11 and 43, the gas purging valve 49, and an arrangement structure therearound will be described in more detail as follows. Recycle gas compressors 45 and 47 compressing the recycle gas passing through the heat exchanging units 20, 21, and 23 to provide the compressed recycle gas to the natural gas feed stream 10 may be installed in the recycle gas circulation lines 11 and 43. The recycle gas compressors 45 and 47 may be two-stage compressor including a first recycle gas compression stage 45 and a second recycle gas compression stage 47. A recycle gas compressor intercooler 46 cooling the recycle gas stream that is increased in temperature while being compressed by the first recycle gas compressor stage 45 up to an inflow temperature of the second recycle gas compression stage 47 may be installed in a pipeline connecting an outlet part of the first recycle gas compression state 45 to an inlet part of the second recycle gas compression stage 47. Also, a recycle gas compressor aftercooler 48 cooling the recycle gas stream that is increased in temperature while being compressed by the second recycle gas compression stage 47 may be installed in a pipeline 11 [that is, a portion of the recycle gas circulation lines 11 and 43] at which the recycle gas is combined into the natural gas feed stream 10 from the second recycle gas compression stage 47.

The gas purging valve 49 may be connected to a power generation module 52 that generates power by using the recycle gas as a fuel to provide at least a portion of the generated power to the gas compressors 15 and 17. That is, the recycle gas discharged from the gas purging valve 49 may be circulated along the recycle gas circulation lines 11 and 43 and be provided to the power generation module 2 so that the recycle gas is supplied as a fuel and used for producing power without being discarded even after being discharged from the bypass lines 40, 41, and 42. As illustrated in the drawing, a branch line 44 that is branched from a connection point, at which the bypass lines 40, 41, and 42 and the recovery gas circulation lines 11 and 43 are connected to each other, to the power generation module 52 may be provided. A portion of the recycle gas may be supplied to the power generation module 52 through the branch line 44. Particularly, the above-described gas purging valve 49 may be provided as a three-way valve controlling a flow path at the point, at which the bypass lines 40, 41, and 42, the recycle gas circulation lines 11 and 43, and the branch line 44 are combined, to distribute the recycle gas and control a discharge amount of recycle gas discharged from the bypass lines 40, 41, and 42 and a circulation amount of recycle gas through the recycle gas circulation lines 11 and 43 at the same time.

The power generated by using the recycle gas may be recovered to be used again for driving the apparatus. That is, the power generation module 52 may generate power by using the recycle gas discharged from the gas purging valve 49 as a fuel to provide the power to the recycle gas compressors 45 and 47 and the above-described refrigerant compressors 62 and 64. That is, the entire power for driving the gas compressors 15 and 17 installed in the natural gas flow line, the recycle gas compressors 45 and 47 installed in the recycle gas circulation lines 11 and 43, and the refrigerant compressors 62 and 64 installed in the refrigerant cycle [this may be the refrigerant cycle of the above-described refrigerant heat exchanger 21] independent of the bypass lines 40, 41, and 42 to compress the refrigerant that is heat-exchanged with the natural gas circulated through the refrigerant cycle and passing through the high-pressure natural gas [this may be the natural gas passing through the gas compressors 15 and 17] may be received from the power generation module 52 driven by the discharged recycle gas. As described above, the recycle gas may be maximized in utilization to realize an energy-efficient process.

For example, the power generation module 52 may include a power generator and a gas engine. The gas engine may be driven by using a gas fuel including the recycle gas, and the power generator may be connected to the gas engine so as to be driven. The power generation module 52 may be implemented in various forms capable of generating power by receiving the gas fuel such as the recycle gas. The power generated by the power generation module 52 may not be limited to electric power and may be mechanical driving force. That is, the power may be generated by using a generator connected to a gas engine and supplied to each of the compressors, or the mechanical driving force of the gas engine may be directly transmitted to each of the compressors without the generator. In the power generation module 52, an evaporation gas (BOG: Boil-Off Gas) generated by vaporizing the liquefied natural gas may also be used as a fuel in addition to the recycle gas. Thus, an evaporation gas supply line 50 connecting the storage tank 29, in which the liquefied natural gas is stored, to the branch line 44 may be provided. The power generation module 52 may receive a mixed stream 51 of the recycle gas and the evaporation gas, which are supplied through the branch line 44, to produce power.

As described above, in the apparatus for liquefying natural gas 1 according to the first embodiment, the pre-cooling process of the natural gas and the subcooling process accompanying the fluid expansion may be organically integrated with each other so that the whole process is operated energy-efficiently. Also, the energy of the recycle gas during the liquefaction process may be recovered by converting the energy into heat energy that is necessary for pre-cooling and electric energy required for driving the apparatus. Thus, the content of nitrogen that may be accumulated by repeating the cycle may be adjusted through the control of the expansion valve 25 to produce a liquefied natural gas having an acceptable nitrogen concentration without limitation.

Hereinafter, an apparatus for liquefying natural gas according to a second embodiment of the present invention will be described in detail with reference to FIG. 2. Hereinafter, the description will be mainly described based on the differences from the above-described components, and the description of the parts not mentioned separately will be replaced with the above description.

Figure 2:
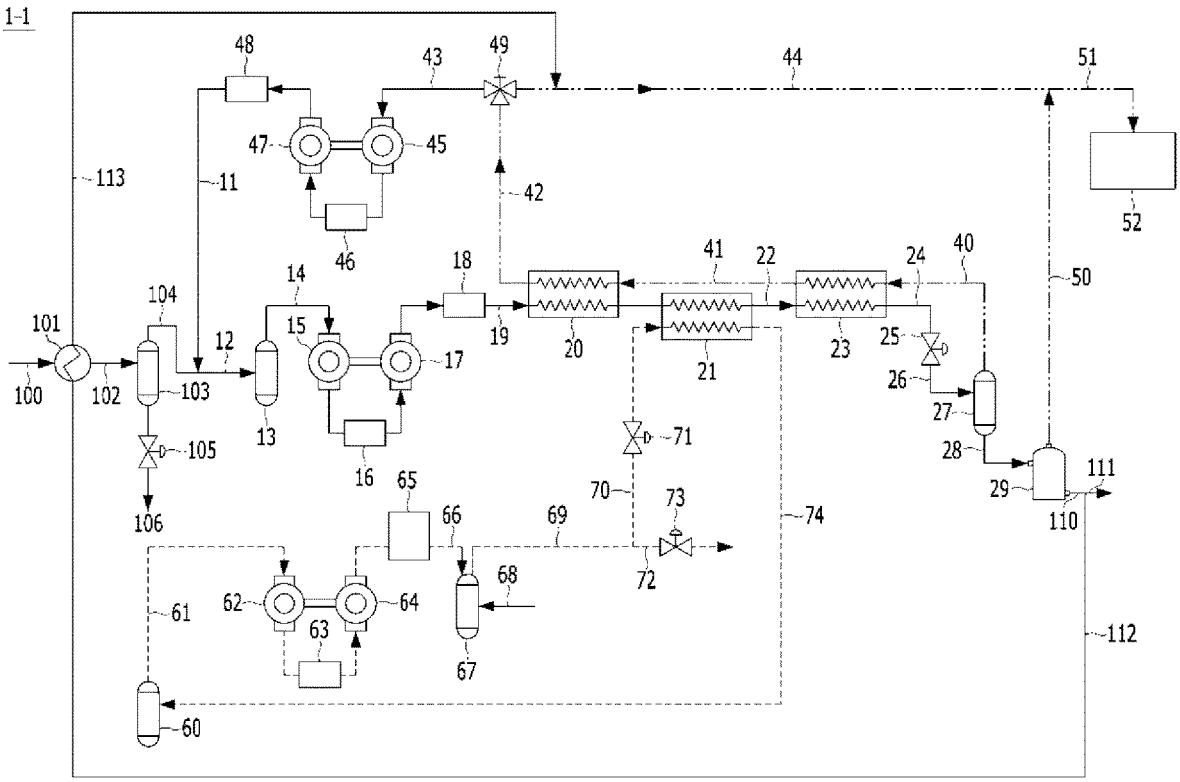
FIG. 2 is a view illustrating a configuration of an apparatus for liquefying natural gas according to a second embodiment of the present invention.

FIG. 2 is a view illustrating a configuration of an apparatus for liquefying natural gas according to a second embodiment of the present invention.

Referring to FIG. 2, an apparatus for liquefying natural gas 1-1 according to the second embodiment uses a portion of a liquefied natural gas discharged from a hold-up drum 27 as a refrigerant. The liquefied natural gas is vaporized through heat-exchange, and a vaporized gas of the vaporized liquefied natural gas is used as a fuel together with a recycle gas discharged from bypass lines 40, 41, and 42 to a power generation module 52. Particularly, since the liquefied natural gas is used in a pretreatment apparatus for removing other impurities such as heavy hydrocarbons contained in the natural gas supplied to the apparatus, liquefaction process will be effective in the case of containing other impurities like hydrocarbons. Also an energy-efficient process is implemented by recycling a product produced in the liquefaction process.

The apparatus for liquefying natural gas 1-1 according to the second embodiment of the present invention is different from the apparatus for liquefying natural gas according to the foregoing first embodiment of the present invention in the following points. The apparatus for liquefying natural gas 1-1 includes a pretreatment cooler 101 heat-exchanging the natural gas supplied to the gas compressors 15 and 17 with a portion of the liquefied natural gas discharged from the hold-up drum 27 to cool the natural gas and a heavy hydrocarbon separator 103 phase-separating the natural gas cooled by passing through the pretreatment cooler 101 to remove liquefied heavy hydrocarbons and supply the gaseous natural gas to the gas compressors 15 and 17. Also, the apparatus for liquefying natural gas 1-1 includes a vaporized gas line 113 combining the vaporized gas of the liquefied natural gas that is vaporized by passing through the pretreatment cooler 101 with the recycle gas discharged from the bypass lines 40, 41, and 42 to the power generation module 52. Since other constituents are substantially the same as those according to the foregoing first embodiment, their duplicated descriptions will be omitted.

In this embodiment, a natural gas feed stream 100 contains the heavy hydrocarbons in addition to the nitrogen. The natural gas may have different specifications or components depending on the place of production. A feed gas produced in certain several regions such as Iran and the like and transported through pipelines may have a high content of heavy hydrocarbons, which has a carbon content equal to or greater than $C_4$ or $C_5$. If the liquefaction process proceeds without properly treating the heavy hydrocarbons, the produced liquefied natural gas may not meet the specifications required by the consumer site, especially, a low heating value (LHV), and the heavy hydrocarbon components with a high liquefaction temperature may be frozen during the liquefaction process.

This limitation may be effectively solved by the pretreatment cooler 101 and the heavy hydrocarbon separator 103 according to this embodiment. In the natural gas feed stream 100, the heavy hydrocarbon components may be removed by sequentially passing through the pretreatment cooler 101 and the heavy hydrocarbon separator 103, which are disposed on a front end of a gas compressor suction drum 13. The cryogenic liquefied natural gas supplied to the pretreatment cooler 101 is heat-exchanged with the natural gas of the natural gas feed stream 100 to liquefy the heavy hydrocarbon components contained in the natural gas. Thereafter, the cooled natural gas passing through the pretreatment cooler 101 is phase-separated in the heavy hydrocarbon separator 103 to remove the liquefied heavy hydrocarbons and supply the gaseous natural gas to the gas compressors 15 and 17. The heavy hydrocarbon separator 103 may be provided as a gas-liquid separator separating a gas-liquid mixture.

As necessary, a heavy hydrocarbon discharge valve 105 controlling an amount of liquid heavy hydrocarbons discharged from the heavy hydrocarbon separator 103 may be provided. The heavy hydrocarbons condensed and discharged in the heavy hydrocarbon separator 103 may be a hydrocarbon component having a carbon content equal to or greater than that of $C_2$, $C_3$, or $C_4$ such as ethane, propane, i-butane, n-butane, i-pentane, n-pentane, and the like. Butane, pentane, and the like may cause limitations such as freeze in the pipelines and the respective components of the apparatus for liquefying natural gas. However, this limitation may be effectively solved through the constituents according to this embodiment.

The vaporized gas of the liquefied natural gas, which is vaporized through the heat-exchange in the pretreatment cooler 101, may be supplied to the above-described branch line 44 along the vaporized gas line 113. That is, as described above, a power generation module 52 may be driven by using the recycle gas discharged from the bypass lines 40, 41, and 42 to the power generation module 52 through the gas purging valve 49 and the vaporized liquefied natural gas as fuels. Also, since the evaporized gas vaporized in the storage tank 29 may be combined through an evaporation gas supply line 50 so as to be used, the fuel may be sufficiently supplied to the power generation module 52, and the power driving the apparatus may be smoothly supplied. The natural gas liquefaction process may be smoothly performed through the above-described constituents.

Hereinafter, an apparatus for liquefying natural gas according to a third embodiment of the present invention will be described in detail with reference to FIG. 3. Hereinafter, the description will be mainly described based on the differences from the above-described components, and the description of the parts not mentioned separately will be replaced with the above description.

Figure 3:
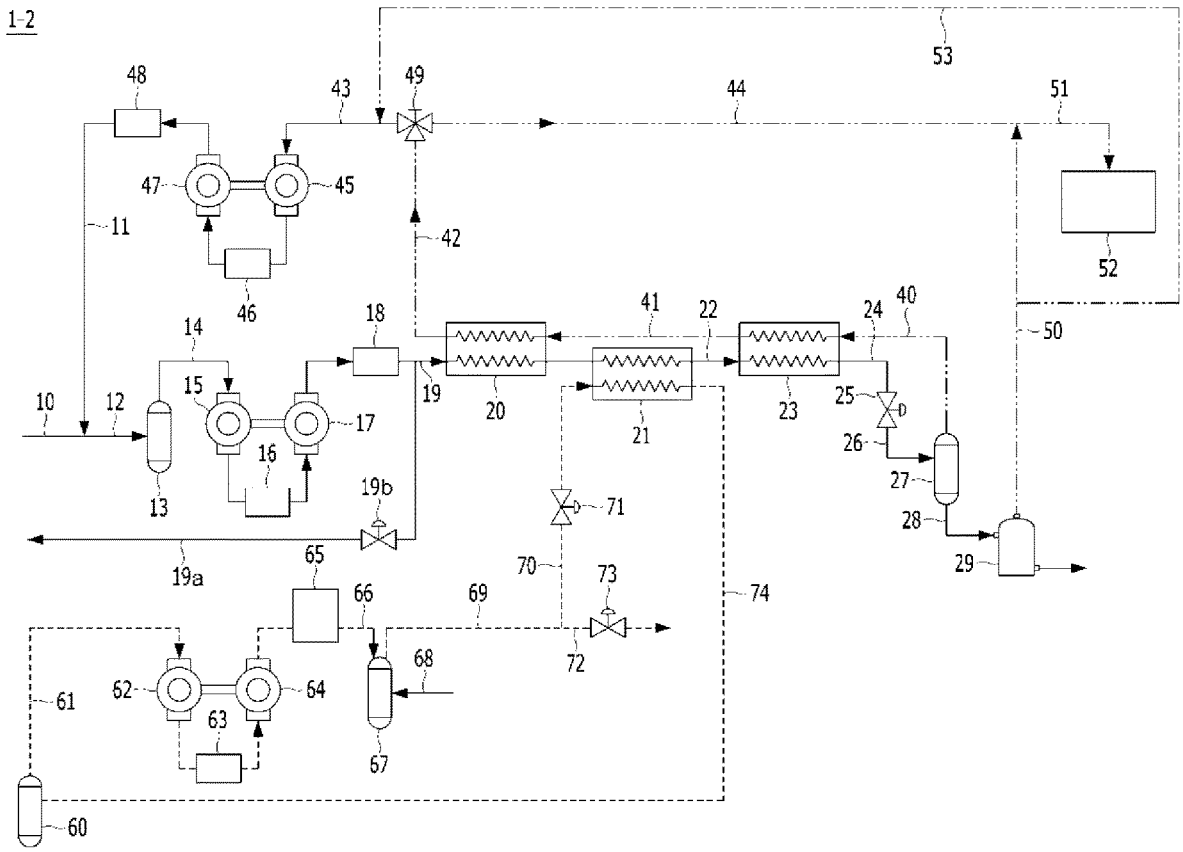
FIG. 3 is a view illustrating a configuration of an apparatus for liquefying natural gas according to a third embodiment of the present invention.

FIG. 3 is a view illustrating a configuration of an apparatus for liquefying natural gas according to a third embodiment of the present invention.

Referring to FIG. 3, an apparatus for liquefying natural gas 1-2 according to the third embodiment of the present invention directly produces a product that is generally called a compressed natural gas (CNG) during a process to provide the product as an output product. That is, since a process of pressing a natural gas is accompanied during a process of liquefying the natural gas, the compressed natural gas may be provided as the product. Particularly, the apparatus according to this embodiment may be adequately controlled to adjust a ratio of providing the compressed natural gas as a product and a ratio of providing the liquefied natural gas as a product throughout the liquefaction process, and thus, a driving state of the apparatus may be controlled according to the ratios.

The apparatus for liquefying natural gas 1-2 according to the third embodiment is different from the apparatus for liquefying natural gas according to the foregoing first embodiment in the following points. The apparatus for liquefying natural gas 1-2 includes a compressed natural gas (CNG) discharge line 19*a* that branches a high-pressure natural gas stream passing through gas compressors 15 and 17 at a front end of the above-described heat exchanging units 20, 21, and 23 to discharge at least a portion of a high-pressure natural gas to the outside. Also, the apparatus for liquefying natural gas 1-2 may include an evaporation gas circulation line 53 supplying an evaporation gas generated in a storage tank 29, in which the liquefied natural gas is stored, to recycle gas circulation lines 11 and 43, to combine the evaporation gas into a natural gas feed stream 10. Also, in the apparatus for liquefying natural gas 1-2 according to this embodiment, the above-described gas compressors 15 and 17, recycle gas compressors 45 and 47, and refrigerant compressors 62 and 64 may be controlled in output according to a ratio of the high-pressure natural gas discharged to the compressed natural gas discharge line 19*a* to the high-pressure natural gas passing through the gas compressors 15 and 17. Since other constituents are substantially the same as those according to the foregoing first embodiment, their duplicated descriptions will be omitted.

The compressed natural gas may be produced through the compressed natural gas discharge line 19*a*. The compressed natural gas may be substantially the same as the high-pressure natural gas compressed by passing through the gas compressors 15 and 17. That is, the high-pressure natural gas compressed at a high pressure (for example, 250 bars) before the pre-cooling in heat exchanging units 20, 21, and 23 may be branched into the compressed natural gas discharge line 19*a* and then discharged. Thus, the compressed natural gas may be produced without performing a separate process. A flow rate of the discharge stream may be adjusted by a control valve 19*b* or the like provided in the compressed natural gas discharge line 19*a*. As described above, when a portion of the high-pressure natural gas is branched and discharged, a flow rate of the natural gas to be treated in the subsequent process may be reduced. Therefore, the flow rate of the natural gas may be adjusted corresponding to outputs of the recycle gas compressors 45 and 47 provided in the recycle gas circulation lines 11 and 43 and the refrigerant compressors 62 and 64 provided in a refrigerant cycle of the heat exchanging units 20, 21, and 23. Also, the evaporation gas supplied to the recycle gas circulation lines 11 and 43 through the evaporation gas circulation line 53 may be compressed in the recycle gas compressors 45 and 47 and be combined into the natural gas feed stream 10 and then be recycled as the liquefied natural gas through a subsequent liquefaction process. As described above, the compressed natural gas may be produced by using the compressed natural gas discharge line 19*a* without performing a separate process, and the outputs of the gas compressors 15 and 17, the recycle gas compressors 45 and 47, and the refrigerant compressors 62 and 64 may be adjusted according to the production amount of compressed natural gas. Also, the shortage of the reduced liquefied natural gas may be compensated through the recycling process of the evaporation gas. Due to the above-described constituents, the natural gas liquefaction process may be smoothly performed, and the compressed natural gas may be produced at a time through a single process.

Hereinafter, an apparatus for liquefying natural gas according to a fourth embodiment of the present invention will be described in detail with reference to FIG. 4. Hereinafter, the description will be mainly described based on the differences from the above-described components, and the description of the parts not mentioned separately will be replaced with the above description.

Figure 4:
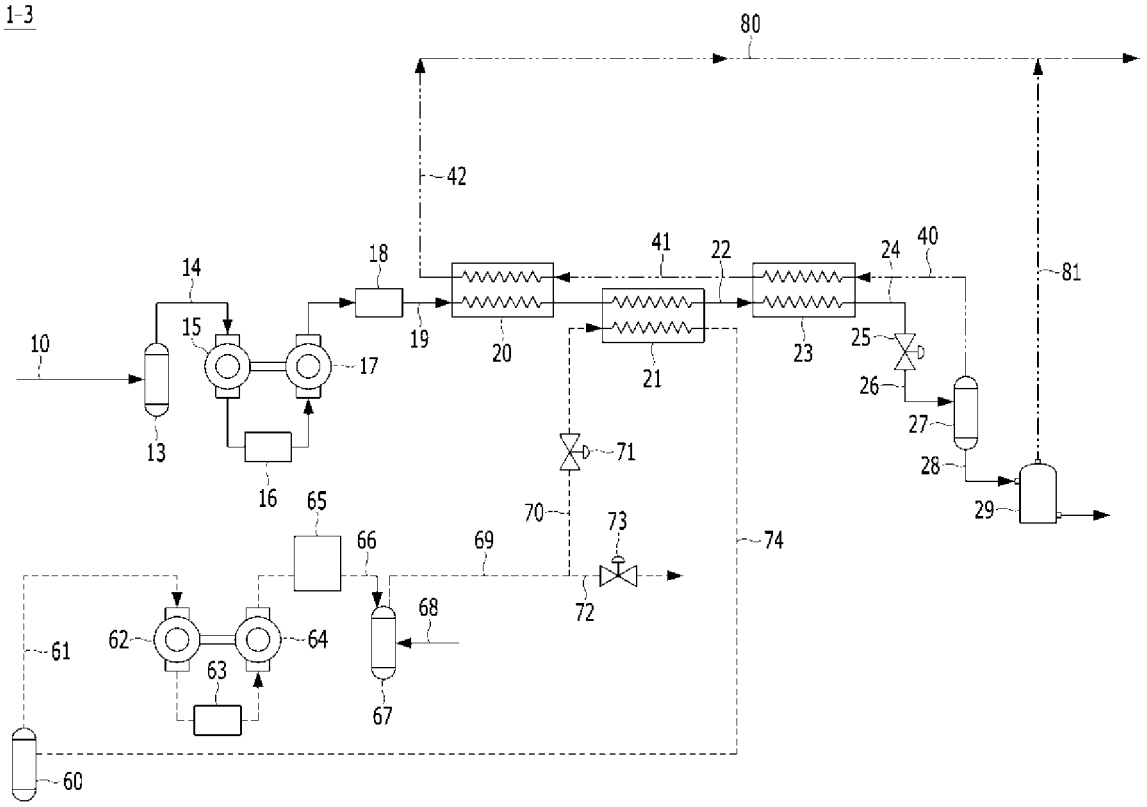
FIG. 4 is a view illustrating a configuration of an apparatus for liquefying natural gas according to a fourth embodiment of the present invention.

FIG. 4 is a view illustrating a configuration of an apparatus for liquefying natural gas according to a fourth embodiment of the present invention.

Referring to FIG. 4, in an apparatus for liquefying natural gas 1-3 according to the fourth embodiment of the present invention, a recycle gas is discharged from bypass lines 40, 41, and 42 to a supply line 80 without the above-described recycle gas circulation line (see reference numerals 11 and 43 of FIGS. 1 to 3), and then, the recycle gas discharged through the supply line 80 is supplied to a consumer site. This configuration may be particularly useful for providing the natural gas while converting a gas pressure between a supply station, to which the natural gas is supplied in a natural gas supply manner such as a piped natural gas (PNG), and a consumer site [for example, a power station and the like using a gas turbine]. Like the foregoing embodiments, this embodiment is also energy-efficient.

The apparatus for liquefying natural gas 1-3 according to the fourth embodiment is different from the apparatus for liquefying natural gas according to the foregoing first embodiment in the following points. The apparatus for liquefying natural gas 1-3 includes a supply line 80 connected bypass lines 40, 41, and 42 to supply a recycle gas discharged from the bypass lines 40, 41, and 42 to a consumer site without the recycle gas circulation lines (see reference numerals 11 and 43 of FIG. 1), the recycle gas compressors (see reference numerals 45 and 47 of FIG. 1), and the power generation module (see reference numeral 52 of FIG. 1). Also, the apparatus for liquefying natural gas 1-3 may include a storage tank 29 storing a liquefied natural gas discharged from a hold-up drum 27 and an evaporation gas combining line 81 combining an evaporation gas generated in the storage tank 29 into the supply line 80. The storage tank 29 may be substantially the same as the above-described storage tank. Also, the gas purging valve (see reference numeral 49 of FIG. 1) may be substantially the same as the above-described gas purging valve. The gas purging valve may be provided or not be provided as necessary. Since other constituents are substantially the same as those according to the foregoing first embodiment, their duplicated descriptions will be omitted.

The supply line 80 is connected to the bypass lines 40, 41, and 42 to extend to the consumer site. Although not shown, the supply line 80 may be connected to an intermediate-pressure gas pipe extending to the consumer site. In this embodiment, a natural gas feed stream 10 may be supplied through a high-pressure gas pipe, and may be pressed at a pressure of, for example, about 30 bars to about 70 bars. As described above, the natural gas feed stream 10 may be decompressed through a series of processes via gas compressors 15 and 17, heat exchanging units 20, 21, and 23, an expansion valve 25, and a hold-up drum 27 and then converted into a liquefied natural gas stored in the storage tank 29 so as to be used. The liquefied natural gas stored in the storage tank 29 may be decompressed at a pressure of about 4 bars to about 10 bars.

In this process, the produced recycle gas may be heat-exchanged while passing through the bypass lines 40, 41, and 42 as described above. However, the recycle gas discharged from the bypass lines 40, 41, and 42 may be directly supplied to the consumer site along the supply line 80 without performing a separate compression process. That is, only cryogenic heat energy of the recycle gas may be recovered through the above-described heat exchange process, and then, the recycle gas may be supplied to the consumer site through the supply line 80 without performing the separate compression process. Thus, unlike the foregoing embodiment, unnecessary energy waste may be eliminated by reducing energy used in the recycle gas compressors 45 and 47. Also, it is unnecessary to perform an additional process in addition to the basic decompression process so as to supply the gas fuel such as the recycle gas to the consumer site. Here, since the recycle gas is used as an energy source providing heat energy through heat-exchange as well as a product supplied to the consumer site, the entire system may be operated energy-efficiently.

As described above, the recycle gas supplied through the supply line 80 may have a pressure of about 4 bars to about 10 bars, which is capable of satisfying specifications of the intermediate-pressure gas pipe connected to the consumer site. Thus, the natural gas may be easily decompressed between a high-pressure gas pipe and the intermediate-pressure gas pipe through the above-described constituents so as to be supplied. Also, heat energy introduced and discharged during the decompression process may be effectively recovered through the above-described heat-exchange of the recycle gas, and thus, the apparatus may be effectively operated without energy waste. Also, the evaporation gas generated in the storage tank 29 may be combined with the recycle gas in the supply line 80 through an evaporation gas combining line 81 so as to be supplied to the consumer site. Thus, the natural gas may also be supplied to the consumer site without waste. The present invention may be effectively applied to the natural gas supply method using the gas pipe in the above-described manner.

Hereinafter, a method for liquefying natural gas according to the present invention will be described in detail based on the above description of the apparatus for liquefying natural gas. Hereinafter, the method for liquefying natural gas is performed using the above-described apparatus for liquefying natural gas and will be described with reference to FIGS. 1 to 4 according to the foregoing embodiments. The description of each of the constituents of the apparatus for liquefying natural gas will be replaced with the above description, unless otherwise mentioned.

A method for liquefying natural gas according to the present invention includes following processes. A method for liquefying natural gas includes a process (a) of receiving a natural gas from a natural gas feed stream to compress the natural gas by using a gas compressor, a process (b) of cooling the high-pressure natural gas passing through the gas compressor through heat-exchange in a heat exchanging unit, a process (c) of expanding the cooled natural gas passing through the heat exchanging unit in an expansion valve to subcool the natural gas, a process (d) of phase-separating a gas-liquid mixture produced by passing through the expansion valve in a hold-up drum to divide the gas-liquid mixture into a liquefied natural gas and a cryogenic recycle gas having nitrogen content greater than that of the liquefied natural gas and thereby to discharge the liquefied natural gas and the cryogenic recycle gas, and a process (e) of providing the recycle gas discharged from the hold-up drum to the heat exchanging unit through a bypass line so as to be heat-exchanged, in which at least a portion of the recycle gas passing through the heat exchanging unit is discharged from the bypass line. Particularly, the process (e) includes a process of combining at least a portion of the recycle gas discharged from the bypass line through a recycle gas circulation line connected to the bypass line into a natural gas feed stream to control a discharge amount of recycle gas in the bypass line and thereby to adjust an amount of nitrogen accumulated in the natural gas feed stream. This process may be performed in a manner in which a circulation amount of recycle gas is increased or decreased according to a required concentration of the nitrogen contained in the liquefied natural gas.

Hereinafter, each of the processes will be described in more detail on the basis of the apparatus for liquefying natural gas according to the foregoing first embodiment [FIG. 1].

First, the process (a) of receiving the natural gas from the natural gas feed stream to compress the natural gas by using the gas compressor is performed. In the natural gas feed stream 10, impurities except nitrogen may be removed through pretreatment. As described above, the natural gas feed stream 10 may be combined with the recycle gas supplied from the recycle gas circulation lines 11 and 43 connected to the bypass lines 40, 41, and 42 so as to be provided as a combined stream 12. The natural gas [this may be combined with the recycle gas and increased in nitrogen concentration] supplied from the combined stream 12 may be introduced into a gas compressor suction drum 13 to remove any condensation. Then, the natural gas that is in a dry state may be compressed in the gas compressors 15 and 17. In the gas compressors 15 and 17, the natural gas may be compressed at a pressure of 240 barg to 260 barg, or a pressure of 245 barg to 255 barg, or a pressure of about 249 barg.

Particularly, the natural gas may be compressed at a pressure of about 92 barg in a first gas compression stage 15 of the gas compressors and be cooled at a temperature of about 55° C. in a gas compressor intercooler 16 including an air-cooling type heat exchanger in which a module function is maintained even at a remote place. The natural gas may be compressed at a pressure of about 250 barg in a second gas compression stage 17. Here, the natural gas may be in a supercritical or dense phase. As described above, the compressed natural gas may be cooled at a temperature of about 55° C. in a gas compressor aftercooler 18 including the air cooling-type heat exchanger.

Although not shown, the high-pressure natural gas cooled in the gas compressor aftercooler 18 may be transferred to a series of filters to remove any lubricating oil leaked from a cylinder of each of the gas compressors 15 and 17. The lubricating oil may be removed to prevent the lubricating oil from being frozen during the liquefaction process and prevent the lubricating oil from being accumulated into cryogenic heat exchangers and other components. The lubricating oil may be removed up to at least 1 ppm.

Thereafter, the process (b) of cooling the high-pressure natural gas passing through the gas compressor through the heat-exchange in the heat exchanging unit is performed. The high-pressure natural gas may be introduced into the heat exchanging units 20, 21, and 23 along a line disposed at a rear end of an aftercooler 18 and then be cooled. The cooled high-pressure natural gas may pass through a high-temperature heat exchanger 20, a refrigerant heat exchanger 21, and a low-temperature heat exchanger 23 in the heat exchanging units and then cooled in stages. As a result, the cooled high-pressure natural gas may have a temperature of about −50° C. to about −75° C., about −55° C. to about −70° C., or about −65° C.

Particularly, the high-pressure natural gas may be first introduced into the high-temperature heat exchanger 20 and then cooled at a temperature of about 22° C. by being heat-exchanged with the recycle gas. The recycle gas supplied to the high-temperature heat exchanger 20 may increase in temperature after being heat-exchanged in the low-temperature heat exchanger 23 and then be supplied through a portion 41 of the bypass lines 40, 41, and 42. The high-pressure natural gas cooled in the high-temperature heat exchanger 20 is transferred to the refrigerant heat exchanger 21.

The compressed natural gas discharged from the refrigerant heat exchanger 21 after being cooled may be maintained in a predetermined temperature by controlling a flow rate of a propane liquid introduced into the refrigerant heat exchanger 21. The flow rate of the propane liquid introduced into the refrigerant heat exchanger 21 may be continuously reset by a temperature control loop to satisfy temperature requirements of the natural gas cooled in and discharged from the refrigerant heat exchanger 21. This may be performed by cascade control.

The refrigerant cycle will be described in more detail. As described above, propane may be used as a working fluid of the refrigerant cycle, which is contained in the refrigerant compressors 62 and 64. However, the present invention is not limited thereto. For example, fluorocarbons, hydrofluorocarbons, or the like may be used as the working fluid.

The propane refrigerant cycle may be utilized to improve efficiency of the apparatus for liquefying. The propane circulated in the refrigerant cycle may be heat-exchanged with the compressed natural gas introduced into the refrigerant heat exchanger 21 to cool the compressed natural gas up to a temperature of about −25° C. The low-pressure propane discharged after being heat-exchanged in the refrigerant heat exchanger 21 may be supplied to a refrigerant compressor suction drum 60. Any condensate in the low-pressure propane introduced into the refrigerant compressor suction drum 60 is captured in the refrigerant compressor suction drum 60 to protect a compressor head of each of the refrigerant compressors 62 and 64 from droplets accompanied in a sprayed state.

The dried propane refrigerant discharged from the refrigerant compressor suction drum 60 may be transferred to the refrigerant compressors 62 and 64 and compressed at a pressure of about 4.7 barg in a first refrigerant compression stage 62 of the refrigerant compressors 62 and 64. The propane refrigerant compressed in the first refrigerant compression stage 62 may be introduced into a refrigerant compressor intercooler 63 and then cooled to a temperature of about 55° C. The refrigerant compressor intercooler 63 may use an air-cooling type heat exchanger due to its own requirements. The propane refrigerant cooled in the refrigerant compressor intercooler 63 is compressed again at a pressure of about 18.5 barg in a second refrigerant compression stage 64. The propane refrigerant compressed in the second refrigerant compression stage 64 may be introduced into a refrigerant compressor aftercooler 65 and then cooled to a temperature of about 55° C. Here, the propane refrigerant may be completely condensed into a liquid phase.

The condensed liquid propane refrigerant may be introduced into a surge drum 67 in which most of the propane refrigerant is stored. As necessary, the propane refrigerant may be made-up to be supplied into the surge drum 67. The made-up propane may be properly dehydrated so that moisture content is less than 1 ppm.

The propane refrigerant may be discharged from the surge drum 67 and expanded in a refrigerant control valve 71 provided in each of the refrigerant circulation lines 61, 66, 69, 70, and 74 so as to be subcooled. The refrigerant control valve 71 may be a Joule-Thomson valve. The liquid propane refrigerant may be decreased in temperature to about −28° C. by isenthalpic expansion and partially evaporated. For example, Joule-Thomson expansion may be controlled by using a cascade loop so that the refrigerant control valve 71 serves as a flow rate control valve. The refrigerant control valve 71 may monitor and maintain a temperature in a downstream of the refrigerant heat exchanger 21 and thus be controlled according to a set value that is continuously reset.

As necessary, the refrigerant may be controlled by using the refrigerant control valve 73 of the refrigerant discharge line 72. For example, the refrigerant discharged from the refrigerant cycle may pass through the refrigerant control valve 73 and then be expanded in the Joule-Thomson process and converted into a pressure of 1 barg and a temperature of −25° C. Here, the refrigerant may be used for cooling a feed gas or provided for other heat-exchange processes. The completely evaporated propane refrigerant may be transferred to the suction drum 60 to perform a subsequent compression process again.

A two-phase propane stream may be completely evaporated in a downstream of the refrigerant heat exchanger 21 and recirculated into the refrigerant compressor suction drum 60. Thus, a loop of the propane refrigerant cycle is formed. The liquid propane is also used to pre-cool the natural gas (the feed gas) containing nitrogen introduced after removing impurities such as carbon dioxide and water. This procedure maximizes overall system efficiency without requiring additional equipment.

The natural gas stream 22 cooled in and discharged from the refrigerant heat exchanger 21 is introduced again into the low-temperature heat exchanger 23. In the low-temperature heat exchanger 23, the natural gas may be cooled up to a temperature of about −65° C. by the heat-exchange with the recycle gas introduced from the hold-up drum 27 to the low-temperature heat exchanger 23.

Thereafter, the process (c) of expanding the cooled natural gas passing through the heat exchanging unit through the expansion valve to subcool the natural gas is performed. The natural gas stream 24 discharged from the low-temperature heat exchanger 23 may be introduced into the expansion valve 25 and then be isenthalpic-expanded up to a pressure of about 4 barg to about 8 barg, about 5 barg to about 7 barg, or about 6 barg while passing through the expansion valve 25. As described above, the expansion valve 25 may expand the high-pressure natural gas cooled through the Joule-Thomson process so as to be subcooled. The temperature of the fluid stream 26 generated by the Joule-Thomson expansion may decrease up to about −133° C. to about −135° C., and it may be partially liquefied according to the subcooling. That is, a two-phase gas-liquid mixture may be produced through the expansion valve 25.

Thereafter, the process (d) of phase-separating the gas-liquid mixture produced by passing through the expansion valve in the hold-up drum to divide the gas-liquid mixture into the liquefied natural gas and the cryogenic recycle gas having nitrogen content greater than that of the liquefied natural gas and thereby to discharge the liquefied natural gas and the cryogenic recycle gas is performed. The two-phase gas-liquid mixture passing through the expansion valve 25 may be phase-separated in the hold-up drum 27 and then divided into the liquefied natural gas and the cryogenic recycle gas having the high nitrogen content so as to be discharged. As described above, the hold-up drum 27 may be provided as a gas-liquid separator that separates the mixed fluid into a gas and a liquid. The liquefied natural gas may be discharged from a bottom part of the hold-up drum 27 and stored in the storage tank 29. The storage tank 29 may be designed to operate at a pressure of about 5 barg. The cryogenic gas stream separated from the liquefied natural gas in the hold-up drum 27 may be discharged through an upper end of the hold-up drum 27 as a recycle gas. As described above, the gas-liquid mixture may be phase-separated to be respectively discharged through separate paths.

Thereafter, the process (e) of providing the recycle gas discharged from the hold-up drum to the heat exchanging unit through the bypass line so as to be heat-exchanged, in which at least a portion of the recycle gas passing through the heat exchanging unit is discharged from the bypass line is performed. As described above, in this process, at least a portion of the recycle gas discharged from the bypass line through the recycle gas circulation line connected to the bypass line may be combined into the natural gas feed stream. Here, the discharge amount of recycle gas in the bypass line may be controlled to adjust the amount of nitrogen accumulated in the natural gas feed stream. The bypass lines 40, 41, and 42 and the recycle gas circulation lines 11 and 43 may be provided in plurality, and the recycle gas may move along the lines.

Specifically, the recycle gas is supplied first to the low-temperature heat exchanger 23. The recycle gas separated from the hold-up drum 27 is used as a refrigerant for liquefying the natural gas in the low-temperature heat exchanger 23. The recycle gas may be increased in temperature by the heat-exchange in the low-temperature heat exchanger 23, and a temperature of the recycle gas discharged from the low-temperature heat exchanger 23 at an outlet may be about −28° C. Thereafter, the recycle gas may pass again through the high-temperature heat exchanger 20 and then be heat-exchanged with the high-pressure natural gas at a front end of the low-temperature heat exchanger 23 to be more increased in temperature. Then, the recycle gas may pass through a gas purging valve 49 through a portion 42 of the bypass lines 40, 41, and 42.

According to this embodiment, in a self-refrigerated liquefaction cycle, the nitrogen may be easily accumulated in a recirculation loop such as the bypass lines 40, 41, and 42 and the recycle gas circulation lines 11 and 43. Since the liquefaction temperature is lower than that of methane that is a main component of the natural gas, nitrogen remains in a gaseous state even at the liquefaction temperature of methane. Thus, since the recycle gas contains nitrogen, as the circulation is repeated, nitrogen content of recycle gas gradually increases.

Thus, the purging of the recycle gas is required to meet nitrogen specifications of the liquefied natural gas, reduce power consumption, and increase liquefaction efficiency. According to this embodiment, the gas purging valve 49 as a recycle gas purging means may be provided in each of the bypass lines 40, 41, and 42. Thus, a portion of the recycle gas may be discharged from the bypass lines 40, 41, and 42. The purging of the recycle gas may be performed from an upstream of the recycle gas compressors 45 and 47 to the power generation module 52 through the gas purging valve 49.

According to this embodiment, in order to maintain nitrogen content of the recycle gas to a predetermined level or less, a portion of the recycle gas or the recycle gas at a specific time point may be purged. The purged recycle gas may be provided as a fuel of the power generation module 52 and thus used for producing power. That is, the recycle gas stream recirculated along the bypass lines 40, 41, and 42 may be branched, for example, into two streams. Most of the recycle gas stream 42 may be combined into the natural gas feed stream 10 introduced into the gas compressors 15 and 17. However, a portion of the recycle gas stream 42 may be removed from the recycle gas cycle along the branch line 44.

The recycle gas purging stream 44 [that is, the recycle gas stream in the branch line] removed from the recycle gas cycle may be combined with an evaporation gas stream discharged from the storage tank 29 along an evaporation gas supply line 50. The recycle gas is supplied to the power generation module 52 as a stream 51 combined with the evaporation gas. As described above, power required for driving this system such as the gas compressors 15 and 17, the recycle gas compressors 45 and 47, and the refrigerant gas compressors 62 and 64 may be supplied from the power generation module 52 by using the recycle gas as a fuel. A control method according to the driving of each compressor and an amount of recycle gas for maintaining the proper nitrogen concentration will be described later in more detail.

The recycle gas discharged from the bypass lines 40, 41, and 42 to the recycle gas circulation lines 11 and 43 without being discharged to the branch line 44 is compressed in the recycle gas compressors 45 and 47 and then combined into the natural gas feed stream 10. The recycle gas before passing through the recycle gas compressors 45 and 47 may have a pressure of about 5.6 barg and may be compressed to a pressure of about 25 to 36 barg, about 30 to 35 barg, or about 31 barg in the recycle gas compressors 45 and 47 and then combined into the natural gas feed stream 10.

Specifically, the recycle gas may be introduced into the first recycle gas compression stage 45 of the recycle gas compressors 45 and 47 and compressed to a pressure of about 13.5 barg and then be introduced into the recycle gas compressor intercooler 46 and cooled to a temperature of about 55° C. The recycle gas compressor intercooler 46 may be provided as an air-cooling type heat exchanger. The recycle gas may be introduced again into the second recycle gas compression stage 47 and compressed to a pressure of about 31 barg and then may be cooled at a temperature of about 55° C. in the recycle gas compressor intercooler 48.

The recycle gas compressed as described above is combined with the natural gas feed stream 10 through a portion 11 of the recycle gas circulation lines 11 and 43 as described above and then is reinjected into the natural gas liquefaction process together with a new feed gas 10 containing nitrogen. In such a manner, the recycle gas may be combined into the natural gas feed stream 10 along the bypass lines 40, 41, and 42 and the recycle gas circulation lines 11 and 43. Also, in this process, at least a portion of the recycle gas may be excluded from the circulation stream [the recycle gas stream circulated along the bypass lines and the recycle gas circulation lines] to control a circulation amount of recycle gas. Thus, an amount of nitrogen accumulated in the natural gas feed stream 10 may be controlled.

Hereinafter, the method of controlling each compressor and the method of adjusting the recycle gas circulation amount will be described in more detail.

In this embodiment, a capacity of the gas compressors 15 and 17 may be controlled through the following two embodiments. For example, a compressor head may be provided with a cylinder unloading system for individual capacity control (0%/50%/100% of a normal flow rate) and be performed manually in a control unit (not shown) by an operator. For another example, the natural gas may be directly supplied to the high-temperature heat exchanger 20 through the continuous control of the entire gas flow by using a bypass valve (not shown) to control the gas flow so that the gas flow matches a set value for a given flow parameter.

Also, a capacity of each of the gas compressors 45 and 47 may be controlled through the following two embodiments. For example, a compressor head may be provided with a cylinder unloading system for individual capacity control (0%/50%/100% of a normal flow rate) and be performed manually in a control unit (not shown) by an operator. For another example, in order to maintain a desired suction pressure, the bypass valve (not shown) may be used to indirectly control the compressed recycle gas so that the compressed recycle gas returns to a suction port side.

Also, a capacity of the refrigerant compressors 62 and 64 may be controlled through the following two embodiments. For example, a compressor head may be provided with a cylinder unloading system for individual capacity control (0%/50%/100% of a normal flow rate) and be performed manually in a control unit (not shown) by an operator. For another embodiment, a propane refrigerant flow branched into different lines may be interlocked to be controlled continuously or be respectively controlled continuously by using a refrigerant control valve 71 in the refrigerant cycle and/or a refrigerant control valve 73 in the refrigerant discharge line. Also, the refrigerant compressor head may have a single distance piece that captures a vent to prevent a gas from leaking into the atmosphere.

Table 1 below shows an effect of changing a discharge pressure of the compressor according to various basic system parameters for the general feed gas composition. The pressure was changed from 175 bara to 300 bara at pressure intervals of 25 bar, and the flow rate of the purge gas (that is, the recycle gas discharged from the bypass line to other paths except for the recycle gas circulation line) was 200 kg/hr.

TABLE 1

| Discharge Pressure (bara) | | 175 | 200 | 225 | 250 | 275 | 300 |
|---|---|---|---|---|---|---|---|
| Gas Compressor (15, 17) | Flow Rate (kg/hr) | 2037 | 1912 | 1836 | 1790 | 1760 | 1742 |
| | Power (kW) | 192 | 196 | 201 | 208 | 216 | 224 |
| Recycle gas compressor (45, 47) | Flow Rate (kg/hr) | 1196 | 1071 | 995 | 948 | 919 | 901 |
| | Power (kW) | 132 | 118 | 110 | 105 | 101 | 99 |
| Refrigerant Compressor (62, 64) | Flow Rate (kg/hr) | 1226 | 1182 | 1139 | 1099 | 1063 | 1032 |
| | Power (kW) | 68 | 66 | 63 | 61 | 59 | 58 |
| Total power (kW) | | 392 | 379 | 374 | 374 | 376 | 380 |
| Vapor fraction at Rear End of Joule-Thomson Valve | | 0.70 | 0.68 | 0.66 | 0.65 | 0.65 | 0.64 |

As shown in the results of the above sensitivity analysis, power consumption is minimized when the discharge pressure is from 225 bara to 250 bara.

Also, Tables 2 to 4 below show an influence of the feed gas composition on an amount of gas to be purged to maintain the nitrogen content of the produced liquefied natural gas to, for example, 1.5 mol %. Tables 2 to 4 show the results for different purge gas ratios, respectively.

Table 2 shows an amount of power consumed and a purge flow rate of the recycle gas [that is, a flow rate of the recycle gas discharged through other paths except for the gas circulation line] required to satisfy 1.5 mol % of nitrogen content of the liquefied natural gas produced when about 5.12 mol % of nitrogen is contained in the feed gas.

TABLE 2

| Purge Flow rate (kg/hr) | | 200 | 180 | 160 | 150 | 140 |
|---|---|---|---|---|---|---|
| Power consumption (kW) | Gas Compressor (15, 17) | 208 | 210 | 213 | 215 | 216 |
| | Recycle gas Compressor (45, 47) | 104 | 108 | 113 | 115 | 117 |
| | Refrigerant Compressor (62, 64) | 61 | 61 | 61 | 62 | 62 |
| Total Compression Power Consumption (kW) | | 374 | 380 | 387 | 392 | 395 |
| Mol Fraction of Produced LNG | | 0.0124 | 0.0133 | 0.0144 | 0.0151 | 0.0157 |
| Purge Gas LHV (kJ/kg) | | 37,659 | 37,025 | 36,280 | 35,862 | 35,473 |
| Power Production of Gas Engine (52) (kWe)(@41% efficiency) | | 918 | 818 | 719 | 668 | 622 |
| Feed Gas Flow Rate (kg/hr) | | 842 | 822 | 801 | 792 | 782 |

Referring to Table 2, when the feed gas contains about 5.12 mol % of nitrogen, the purge flow rate of the recycle gas required to satisfy the specifications of the produced liquefied natural gas, i.e., required so that the nitrogen content of liquefied natural gas is 1.5 mol % is about 151 kg/hr.

Table 3 shows an amount of power consumed and a purge flow rate of the recycle gas [that is, a flow rate of the recycle gas discharged through other paths except for the gas circulation line] required to satisfy 1.5 mol % of nitrogen content of the liquefied natural gas produced when about 4.10 mol % of nitrogen is contained in the feed gas.

TABLE 3

| Purge Flow rate (kg/hr) | | 200 | 180 | 160 | 140 | 120 | 110 | 100 |
|---|---|---|---|---|---|---|---|---|
| Power consumption (kW) | Gas Compressor (15, 17) | 212 | 214 | 216 | 218 | 221 | 223 | 224 |
| | Recycle gas Compressor (45, 47) | 104 | 108 | 111 | 115 | 120 | 122 | 125 |
| | Refrigerant Compressor (62, 64) | 62 | 62 | 62 | 62 | 62 | 63 | 63 |
| Total Compression Power Consumption (kW) | | 378 | 384 | 390 | 396 | 403 | 407 | 411 |
| Mol Fraction of Produced LNG | | 0.0107 | 0.0115 | 0.0123 | 0.0133 | 0.0146 | 0.0153 | 0.0161 |
| Purge Gas LHV (kJ/kg) | | 37,941 | 39,426 | 38,843 | 38,159 | 37,345 | 36,899 | 36,390 |
| Power Production of Gas Engine (52) (kWe)(@41% efficiency) | | 977 | 875 | 773 | 673 | 573 | 525 | 476 |
| Feed Gas Flow Rate (kg/hr) | | 842 | 823 | 803 | 783 | 763 | 753 | 743 |

Referring to Table 3, when the feed gas contains about 4.10 mol % of nitrogen, the purge flow rate required to satisfy the specifications of the produced liquefied natural gas (LNG), i.e., required so that the nitrogen content is 1.5 mol % is about 113 kg/hr.

Table 4 shows an amount of power consumed and a purge flow rate of the recycle gas [that is, a flow rate of the recycle gas discharged through other paths except for the gas circulation line] required to satisfy 1.5 mol % of nitrogen content of the liquefied natural gas produced when about 3.30 mol % of nitrogen is contained in the feed gas.

TABLE 4

| Purge Flow rate (kg/hr) | | 200 | 180 | 160 | 140 | 120 | 100 | 80 | 70 |
|---|---|---|---|---|---|---|---|---|---|
| Power consumption (kW) | Gas Compressor (15, 17) | 214 | 215 | 217 | 219 | 221 | 223 | 226 | 227 |
| | Recycle gas Compressor (45, 47) | 103 | 106 | 110 | 113 | 117 | 121 | 126 | 128 |

TABLE 4-continued

| Purge Flow rate (kg/hr) | 200 | 180 | 160 | 140 | 120 | 100 | 80 | 70 |
|---|---|---|---|---|---|---|---|---|
| Refrigerant Compressor (62, 64) | 63 | 63 | 63 | 63 | 63 | 63 | 63 | 63 |
| Total Compression Power Consumption (kW) | 379 | 384 | 389 | 395 | 401 | 407 | 415 | 419 |
| Mol Fraction of Produced LNG | 0.0090 | 0.0095 | 0.0102 | 0.0110 | 0.0120 | 0.0131 | 0.0146 | 0.0155 |
| Purge Gas LHV (kJ/kg) | 41,846 | 41,439 | 40,962 | 40,398 | 39,732 | 38,973 | 38,023 | 37,477 |
| Power Production of Gas Engine (52) (kWe)(@41% efficiency) | 1025 | 921 | 817 | 714 | 612 | 512 | 413 | 364 |
| Feed Gas Flow Rate | 842 | 823 | 803 | 783 | 763 | 743 | 723 | 713 |

(kg/hr)

Referring to Table 4, when the feed gas contains about 3.30 mol % of nitrogen, the purge flow rate of the recycle gas required to satisfy the specifications of the produced LNG, i.e., required so that the nitrogen content is 1.5 mol % is about 75 kg/hr.

As described above, the purge flow rate of the recycle gas, i.e., the amount of recycle gas discharged from the bypass lines 40, 41, and 42 to other paths except for the recycle gas circulation lines 11 and 43 [for example, the branch line 44] may be adjusted to adjust and maintain the nitrogen concentration of the finally produced liquefied natural gas at a desired level. Also, the entire power consumption of the apparatus may be minimized by appropriately controlling the compressor while maintaining a specific purge flow rate of the recycle gas to reduce a load on the power generation module 52. According to this embodiment, a six-throw reciprocating compressor with a general electric driver that provides two-stage compression of the nitrogen-containing natural gas supply product, two-stage compression of the recycle gas, and two-stage compression of the propane refrigerant may be built in.

In the above-described method for liquefying natural gas, the maintenance of functional autonomy capable of treating the nitrogen-containing natural gas supply product is one of the key considerations. The purging of the recycle gas is maintained at a level that provides a constant nitrogen concentration in the recirculation stream. The purging of the recovery gas may be aimed for an engine coupled to a generator that provides the power necessary for driving the compression system. Also, all the heat transfer devices for the process may be air cooling type to maintain the process autonomy. Thus, all field requirements and processes may be completely separated from each other, and thus, the system for liquefying natural gas may be utilized at all sites and places. In this way, the natural gas may be liquefied through the above processes.

The method for liquefying natural gas according to the present invention may further include the following processes in addition to the above-described processes (a) to (e). The method for liquefying natural gas may further include a process of cooling the natural gas supplied to the gas compressor by being heat-exchanged with a portion of the liquefied natural gas discharged from the hold-up drum and a process of phase-separating the cooled natural gas passing through the pretreatment cooler to remove the liquefied heavy hydrocarbons and supply the gaseous natural gas to the gas compressor, before the process (a) [that is, the process of compressing the natural gas by using the gas compressor]. In other words, when the feed gas stream contains impurities such as hydrocarbons in addition to nitrogen, the method for liquefying natural gas further includes a process of pretreating and removing the heavy hydrocarbons before the introduction of the gas compressor.

Hereinafter, this process will be described in more detail on the basis of the apparatus for liquefying natural gas according to the foregoing second embodiment [FIG. 2].

First, the natural gas feed stream 100 passes through the above-described pretreatment cooler 101, and thus, the heavy hydrocarbon component is liquefied. The refrigerant that cools the natural gas feed stream 100 may be the produced liquefied natural gas, and this may be supplied from the branched stream 112 of the liquefied natural gas stream 110 discharged from the storage tank 29 that stores liquefied natural gas. Since the liquefied natural gas is the cryogenic refrigerant, the liquefied natural gas may effectively cool the natural gas of the natural gas feed stream 100 through heat exchange. The vaporized gas of the liquefied natural gas, which is heat-exchanged in the pretreatment cooler 101 and vaporized, may be combined with the recycle gas purged along the vaporized gas line 113 as described above and then be used as the fuel of the power generation module 52.

The cooled natural gas passing through the pretreatment cooler 101 is separated into a gas and a liquid in the heavy hydrocarbon separator 103 to remove the condensed heavy hydrocarbon component. In this way, only natural gas in the gaseous state (i.e., dried gas) may be supplied to the gas compressors 15 and 17. As described above, the natural gas may be supplied to the gas compressors 15 and 17 after passing through the gas compressor suction drum 13 installed at the front end of the gas compressors 15 and 17 to capture any condensation. Thereafter, the above-described respective processes (a) to (e) may be performed.

Table 5 shows a heat and material balance due to the removing of the heavy hydrocarbons according to an embodiment. In Table below, the number of each stream refers to FIG. 2.

TABLE 5

| Stream No. | | | 100 | 102 | 104 | 106 | 110 | 111 | 112 | 113 |
|---|---|---|---|---|---|---|---|---|---|---|
| Total Flow, kgmole/h | | | 48.14 | 48.14 | 46.66 | 1.48 | 46.61 | 35.34 | 11.27 | 11.27 |
| Total Flow, kg/h | | | 904.7 | 904.7 | 843.4 | 61.2 | 843.3 | 639.4 | 203.9 | 203.9 |
| Total Flow, m3/h | | | 34.20 | 23.78 | 23.87 | 0.11 | 2.01 | 2.85 | 0.49 | 40.09 |
| Temperature, ° C. | | | 25.0 | −39.0 | −39.0 | −39.0 | −133.4 | −135.9 | −133.4 | 15.0 |
| Pressure, bara | | | 32.0 | 31.8 | 31.8 | 8.0 | 7.0 | 8.0 | 7.0 | 6.6 |
| Total Vapor Flow, Nm3/h | | | 1,078.93 | 1045.97 | 1,045.87 | 0.00 | 0 | 18 | 0 | 253 |
| Vapor Fraction | | | 1.00 | 0.97 | 1.00 | 0.00 | 0.00 | 0.00 | 0.00 | 1.00 |
| Liquid Fraction | | | 0.00 | 0.00 | 0.00 | 1.00 | 1.00 | 0.95 | 1.00 | 0.00 |
| Average Mole Weight | | | 18.8 | 18.0 | 18.1 | 41.5 | 18.1 | 18.1 | 18.1 | 18.1 |
| Molar flow, kgmole/h | | | | | | | | | | |
| Methane | $CH_2$ | 16.04 | 41.51 | 41.51 | 41.10 | 0.41 | 41.71 | 31.65 | 10.09 | 10.09 |
| Ethane | $C_2H_6$ | 30.07 | 1.97 | 0.97 | 0.81 | 0.15 | 2.38 | 1.80 | 0.58 | 0.58 |
| Propane | $C_3H_5$ | 44.10 | 1.47 | 1.47 | 1.06 | 0.42 | 1.39 | 1.06 | 0.34 | 0.34 |
| i-Butane | $C_4H_{10}$ | 58.12 | 0.25 | 0.25 | 0.11 | 0.13 | 0.15 | 0.11 | 0.04 | 0.04 |
| n-Butane | $C_4H_{10}$ | 58.12 | 0.25 | 0.25 | 0.09 | 0.16 | 0.12 | 0.09 | 0.03 | 0.03 |
| t-Pentane | $C_5H_{12}$ | 72.15 | 0.12 | 0.12 | 0.02 | 0.10 | 0.03 | 0.02 | 0.01 | 0.01 |
| n-Pentane | $C_5H_{12}$ | 72.15 | 0.12 | 0.12 | 0.01 | 0.11 | 0.02 | 0.01 | 0.20 | 0.00 |
| Carbon Dioxide | $CO_2$ | 44.01 | 0.00 | 0.00 | 0.00 | 0.00 | 0.00 | 0.00 | 0.00 | 0.00 |
| Nitrogen | $N_2$ | 28.01 | 2.46 | 2.46 | 2.45 | 0.01 | 0.79 | 0.60 | 0.19 | 0.19 |
| M-Mercaptan | $CH_4S$ | 48.11 | 0.00 | 0.00 | 0.00 | 0.00 | 0.00 | 0.00 | 0.00 | 0.00 |
| E-Mercaptan | $C_2H_6S$ | 62.13 | 0.00 | 0.00 | 0.00 | 0.00 | 0.00 | 0.00 | 0.00 | 0.00 |
| Water | $H_2O$ | 18.02 | 0.00 | 0.00 | 0.00 | 0.00 | 0.00 | 0.00 | 0.00 | 0.00 |
| Mole Fraction | | | | | | | | | | |
| Methane | $CH_4$ | 16.04 | 0.862310 | 0.862310 | 0.880847 | 0.275927 | 0.895443 | 0.895443 | 0.895443 | 0.895443 |
| Ethane | $C_2H_6$ | 30.07 | 0.040840 | 0.04840 | 0.038890 | 0.102522 | 0.051072 | 0.051072 | 0.051072 | 0.051072 |
| Propane | $C_3H_8$ | 44.10 | 0.030630 | 0.030630 | 0.022688 | 0.281839 | 0.029903 | 0.029903 | 0.029903 | 0.029903 |
| i-Butane | $C_4H_{10}$ | 58.12 | 0.005105 | 0.005105 | 0.002444 | 0.089273 | 0.003222 | 0.003222 | 0.003222 | 0.003222 |
| n-Butane | $C_4H_{10}$ | 58.12 | 0.005095 | 0.005095 | 0.001875 | 0.106943 | 0.002472 | 0.002472 | 0.002472 | 0.002472 |
| t-Pentane | $C_5H_{12}$ | 72.15 | 0.002472 | 0.002472 | 0.000413 | 0.067603 | 0.000545 | 0.000545 | 0.000545 | 0.000545 |
| n-Pentane | $C_5H_{12}$ | 72.15 | 0.002482 | 0.002482 | 0.000295 | 0.071681 | 0.000389 | 0.000389 | 0.000389 | 0.000389 |
| Carbon Dioxide | $CO_2$ | 44.01 | 0.000007 | 0.000007 | 0.000007 | 0.000007 | 0.000010 | 0.000010 | 0.000010 | 0.000010 |
| Nitrogen | $N_2$ | 28.01 | 0.051050 | 0.051050 | 0.052535 | 0.004079 | 0.016941 | 0.016941 | 0.016941 | 0.016941 |
| M-Mercaptan | $CH_4S$ | 48.11 | 0.000003 | 0.000003 | 0.000002 | 0.000047 | 0.000002 | 0.000002 | 0.000002 | 0.000002 |
| E-Mercaptan | $C_2H_6S$ | 62.13 | 0.000003 | 0.000003 | 0.000001 | 0.000077 | 0.000001 | 0.000001 | 0.000001 | 0.000001 |
| Water | $H_2O$ | 18.02 | 0.000001 | 0.000001 | 0.000001 | 0.000001 | 0.000001 | 0.000001 | 0.000001 | 0.000001 |

The composition of the natural gas feed stream 100 shown in Table 5 is an example of a typical gas composition applied to the liquefaction process. This stream flows in a direction crossing a slip stream 112 of the liquefied natural gas in the pretreatment cooler 101. In the pretreatment cooler 101, the natural gas feed stream [or the natural gas provided from the natural gas feed stream] may be cooled to a temperature of about −39° C. A vapor fraction of the natural gas stream 102 cooled in the pretreatment cooler 101 may be 0.97, and a liquid fraction may be 0.03.

The liquid separated in the heavy hydrocarbon separator 103 may be discharged under the control of a heavy hydrocarbon discharge valve 105. The liquid fraction discharged from the heavy hydrocarbon separator 103 may be converted into steam under atmospheric pressure condition and may be supplied to the above-described power generation module 52 as an auxiliary fuel source, although not shown in the drawing. In this embodiment, when a flow rate of the liquefied natural gas stream 110 from the storage tank 29 to the consumer site is about 843.3 kg/hr, a flow rate of the slip stream 112 extracted to liquefy the heavy hydrocarbons is about 203.9 kg/hr. Although this process is not an energy-efficient process, this process is a necessary process because it is essential to remove a significant amount of heavy hydrocarbons that may be frozen in large quantities in the liquefaction process. The natural gas may contain impurities such as carbon dioxide ($CO_2$), water ($H_2O$), light hydrocarbons, and nitrogen ($N_2$), and $CO_2$ and $H_2O$ may be easily removed by using molecular sieves, but light hydrocarbons may be treated through condensation thereof. In this manner, the natural gas containing impurities such as the heavy hydrocarbons in addition to the nitrogen may also be effectively liquefied through the above processes.

The method for liquefying natural gas according to the present invention may further include the following other processes in addition to the above-described processes (a) to (e). The method for liquefying natural gas may further include a process of branching the high-pressure natural gas stream passing through the gas compressor into the compressed gas discharge line to discharge a portion of the high-pressure natural gas to the outside between the process (a) [the process of compressing the natural gas by using the gas compressor] and the process (b) [the process of pre-cooling the high-pressure natural gas passing through the gas compressor in the heat exchanging unit]. Particularly, the gas compressors 15 and 17, the recycle gas compressors 45 and 47, and the refrigerant compressors 62 and 64 may be adjusted in output according to a ratio of the high-pressure natural gas, which is discharged to the outside through the branched high-pressure natural gas stream [that is, the stream branched into the compressed gas discharge line], to the high-pressure natural gas passing through the gas compressors 15 and 17.

Hereinafter, this process will be described in more detail on the basis of the apparatus for liquefying natural gas according to the foregoing third embodiment [FIG. 3].

The natural gas passing through the gas compressors 15 and 17 is compressed at a high pressure (for example, about 250 bar) before being pre-cooled in the heat exchanging units 20, 21, and 23 as described above. As described above, the high-pressure natural gas is compressed at a high pressure and is substantially the same as the normal compressed natural gas (CNG). Thus, the branched stream of the high-pressure natural gas may be produced at the front end of the heat exchange units 20, 21, and 23 to produce the compressed natural gas without any additional process. As described above, a portion of the high-pressure natural gas stream passing through the gas compressors 15 and 17 may be branched by using the compressed gas discharge line 19*a* to produce the compressed natural gas.

Here, the flow rate of the natural gas to be treated in the subsequent process may be reduced to correspond to the branched high-pressure natural gas. Thus, the flow rate of the natural gas may be adjusted corresponding to outputs of the recycle gas compressors 45 and 47 provided in the recycle gas circulation lines 11 and 43 and the refrigerant compressors 62 and 64 provided in the refrigerant cycle of the heat exchanging units 20, 21, and 23. Also, as described above, the evaporation gas generated in the storage tank 29 of the liquefied natural gas may be supplied to the recycle gas circulation lines 11 through the evaporation gas circulation line 53 and 43 and combined with the natural gas feed stream 10 to regenerate the evaporation gas into the liquefied natural gas through the subsequent liquefaction process and compensate shortage of the liquefied natural gas. As a result, the compressed natural gas as well as the liquefied natural gas may be produced at a time through a natural gas liquefaction single process.

Specifically, each compressor may be controlled in the following manner. For example, when a production rate of the liquefied natural gas, which is the final product, and the compressed natural gas [that is, the high-pressure natural gas branched and discharged to the compressed gas discharge line to pass through the gas compressor] is 50%:50% [that is, a ratio of the high-pressure natural gas discharged to the outside through the branched high-pressure natural gas stream to the high-pressure natural gas passing through the gas compressor is 1/2], the output of each of the gas compressors 15 and 17 may be adjusted to 100%, and the outputs of each of the recycle gas compressors 45 and 47 and each of the refrigerant compressors 62 and 64 may be adjusted to 50%. The power provided from the power generation module 52 may be used more efficiently through the above-described control.

Also, in some cases, when 100% of only the liquefied natural gas is to be produced, each of the outputs of the gas compressors 15 and 17, the recycle gas compressors 45 and 47, and the refrigerant compressors 62 and 64 may be adjusted to 100% to effectively perform only the above-described liquefaction process [in this case, a portion of the compressed gas discharge line may be closed to remove the branched stream, and a valve for controlling the flow path may be installed in the compressed gas discharge line]. When 100% of only the compressed natural gas is to be produced, other compressors may be stopped, and only the gas compressors 15 and 17 may be driven at an output of 100%. The power provided from the power generation module 52 may also be used more efficiently through the above-described control.

In the method for liquefying natural gas according to the present invention, the process (e) [that is, the process of discharging at least a portion of the recycle gas from the bypass line after heat-exchanging the recycle gas] of the above-described processes (a) to (e) may be performed in a different manner as follows. That is, in the process (e), a process of supplying the recycle gas discharged from the bypass line through the supply line connected to the bypass line to the consumer site may be performed. In the case of this manner, the method for liquefying natural gas may be performed by using the apparatus for liquefying natural gas according to the fourth embodiment. Therefore, the recycle gas circulation lines (see reference numerals 11 and 43 in FIG. 1), the recycle gas compressors (see reference numerals 45 and 47 in FIG. 1), and the power generation module (see reference numeral 52 of FIG. 1) may be removed. That is, the heat energy of the recycle gas may be recovered from the bypass line without circulating stream of the recycle gas and then be directly provided to the consumer site.

Hereinafter, this process will be described in more detail on the basis of the apparatus for liquefying natural gas according to the foregoing fourth embodiment [FIG. 4].

As described above, this process may be usefully applied to the method for supplying natural gas such as PNG using the gas pipe. The supply line 80 may be connected to the bypass lines 40, 41, and 42 to extend to the consumer site. The consumer site may be a power plant using the gas fuel, and the supply line 80 may be connected to the intermediate pressure gas pipe that is directed to the consumer site. In this case, the natural gas feed stream 10 may be pressed at a pressure of 40 bars to 70 bars and be supplied. As described above, the natural gas feed stream 10 may be decompressed through a series of processes via the gas compressors 45 and 47, the heat exchanging units 20, 21, and 23, the expansion valve 25, and the hold-up drum 27 and then converted into the liquefied natural gas stored in the storage tank 29 and used. The liquefied natural gas stored in the storage tank 29 may be decompressed at a pressure of about 8.5 bars.

In this process, the produced recycle gas may be heat-exchanged while passing through the bypass lines 40, 41, and 42 as described above. After being heat-exchanged, the recycle gas discharged from the bypass lines 40, 41, and 42 may be directly supplied to the consumer site along the supply line 80 without performing a separate compression process. That is, cryogenic heat energy of the recycle gas may be recovered through the above-described heat exchange process without being wasted, and then, the recycle gas may be supplied to the consumer site through the supply line 80 without performing separate compression process. The recycle gas supplied through the supply line 80 may have a pressure of about 8.5 bars, which is capable of satisfying specifications of the intermediate-pressure gas pipe connected to the consumer site. Thus, in this process, the natural gas may be easily decompressed between the high-pressure gas pipe and the intermediate-pressure gas pipe through the above-described constituents and be supplied. Also, the heat energy introduced and discharged during the decompression process may be recovered through the heat-exchange of the recycle gas, and thus, the process may be effectively performed without energy waste. Also, as described above, the evaporation gas generated in the storage tank 29 may be combined with the recycle gas in the supply line 80 through an evaporation gas combining line 81 so as to be supplied to the consumer site. Thus, the natural gas may also be supplied to the consumer site without waste. As described above, the present invention may be usefully applied to the process of supplying the natural gas using the gas pipe.

As described above, the natural gas may be efficiently liquefied in the various liquefaction methods according to the present invention. Particularly, the concentration of nitrogen contained in the finally produced liquefied natural gas may be adequately adjusted and maintained while removing the unnecessary impurities from natural gas containing nitrogen or nitrogen and heavy hydrocarbons. In addition, the liquefaction efficiency may be prevented from being decreased by preventing nitrogen from being excessively accumulated in the system during the liquefaction process, and the natural gas liquefaction process may be more efficiently carried out by producing the product of compressed natural gas and liquefied natural gas through the single process.

According to the present invention, the liquefaction process of the natural gas containing nitrogen may be improved to be operated in a more efficient manner. In addition, the effect of energy saving, which reduces use of the unnecessary compound and consumption of the operation energy, may be achieved. The self-completed liquefaction process according to the present invention may be independently implemented, is easy to be applied to various objects, and is excellent in the aspect of energy efficiency. In addition, according to the present invention, natural gas containing nitrogen may be used for the purpose of the energy transport, and simultaneously controlled the accumulation of the nitrogen through the repeating of the sub-process and cycle to maintain the nitrogen content to meet the requirement of the liquefied natural gas, which is the final product. Also, according to the present invention, although the heavy hydrocarbons in addition to the nitrogen are contained, the heavy hydrocarbons may be removed to maintain the desired composition, and such treatment process may also be realized as the complete energy-efficient process. Also, the products of LNG and CNG in different aspects may be produced at the same time through a single process. It also has various technical advantages in which the heat that is easily wasted in the pressure conversion equipment is recovered to be reused.

Although the embodiment of the inventive concept is described with reference to the accompanying drawings, those with ordinary skill in the technical field of the inventive concept pertains will be understood that the present disclosure can be carried out in other specific forms without changing the technical idea or essential features. Therefore, the above-disclosed embodiments are to be considered illustrative and not restrictive.

What is claimed is:

1. An apparatus for liquefying natural gas, the apparatus comprising:

a gas compressor configured to receive the natural gas from a natural gas feed stream and compress the received natural gas to discharge a high-pressure natural gas through a compressed natural gas discharge line;

a heat exchanging unit configured to cool the high-pressure natural gas passing through the gas compressor through heat exchange, wherein the heat exchanging unit includes a high-temperature heat exchanger, a refrigerant heat exchanger, and a low-temperature heat exchanger connected in series through the compressed natural gas discharge line;

an expansion valve configured to expand the cooled natural gas passing through the heat exchanging unit so as to subcool the cooled natural gas;

a hold-up drum configured to phase-separate the subcooled natural gas having a gas-liquid mixture produced by passing through the expansion valve and divide the gas-liquid mixture into a liquefied natural gas and a recycle gas having nitrogen content greater than that of the liquefied natural gas so as to discharge the liquefied natural gas and the recycle gas;

a bypass line configured to provide the recycle gas discharged from the hold-up drum directly back to the heat exchanging unit so as to be heat-exchanged, wherein at least a portion of the recycle gas passing through the heat exchanging unit is discharged from the bypass line;

a recycle gas circulation line connected to the bypass line to combine the at least the portion of the recycle gas discharged from the bypass line into the natural gas feed stream;

a gas purging valve configured to control a discharge amount of the recycle gas from the bypass line to the recycle gas circulation line so as to adjust an amount of nitrogen accumulated in the natural gas feed stream;

a recycle gas compressor configured to compress the recycle gas in the recycle gas circulation line and provide the compressed recycle gas to the natural gas feed stream;

a power generation module configured to generate power by using the recycle gas discharged from the gas purging valve as a fuel so that at least a portion of the generated power is provided to the gas compressor; and a branch line branched from the gas purging valve at a connection point between the bypass line and the recycle gas circulation line to the power generation module, wherein the low-temperature heat exchanger is configured to directly receive the recycle gas discharged from the hold-up drum so that the received recycle gas is heat-exchanged with the high-pressure natural gas, wherein the high-temperature heat exchanger is configured to receive the recycle gas discharged from the low-temperature heat exchanger so that the received recycle gas is heat-exchanged with the high-pressure natural gas at a front end of the low-temperature heat exchanger, and wherein the refrigerant heat exchanger is configured to circulate a refrigerant and heat-exchange between the high-temperature heat exchanger and the low-temperature heat exchanger so that the refrigerant is heat-exchanged with the high-pressure natural gas, wherein the high-temperature heat exchanger and the low-temperature heat exchanger are connected in series to each other through the bypass line, and wherein the refrigerant heat exchanger circulates the refrigerant through a refrigerant cycle that is independent of the bypass line.

2. The apparatus of claim 1, further comprising:

a refrigerant compressor disposed in a refrigerant cycle that is independent of the bypass line to compress the refrigerant circulated through the refrigerant cycle and heat-exchanged with the high-pressure natural gas, wherein the power is provided from the power generation module to the gas compressor, the recycle gas compressor, and the refrigerant compressor.

3. The apparatus of claim 1, wherein the gas purging valve comprises a three-way valve configured to control a flow path at a point at which the bypass line, the recycle gas circulation line, and the branch line are combined with each other.

4. The apparatus of claim 1, further comprising:

a storage tank configured to store the liquefied natural gas discharged from the hold-up drum; and an evaporation gas circulation line configured to supply an evaporation gas produced in the storage tank to the recycle gas circulation line so that the evaporation gas is combined into the natural gas feed stream.

5. The apparatus of claim 1, further comprising a supply line connected to the bypass line to provide the recycle gas discharged from the bypass line to a consumer site.

6. The apparatus of claim 5, further comprising:

a storage tank configured to store the liquefied natural gas discharged from the hold-up drum; and an evaporation gas combining line configured to combine the evaporation gas produced in the storage tank to the supply line.

7. The apparatus of claim 1, further comprising:

a pretreatment cooler configured to heat-exchange the natural gas supplied to the gas compressor with a portion of the liquefied natural gas discharged from the hold-up drum so as to cool the natural gas; and a heavy hydrocarbon separator configured to phase-separate the natural gas cooled by passing through the pretreatment cooler so as to remove liquefied heavy hydrocarbons and supply gaseous natural gas to the gas compressor.

8. The apparatus of claim 1, wherein the compressed natural gas discharge line is disposed at a front end of the heat exchanging unit to branch a stream of the high-pressure natural gas passing through the gas compressor so that at least a portion of the high-pressure natural gas is discharged to an outside.

* * * * *